US011560683B2

(12) United States Patent
Kannegaard et al.

(10) Patent No.: US 11,560,683 B2
(45) Date of Patent: Jan. 24, 2023

(54) OFFSHORE DRILLING UNIT

(71) Applicants: Maersk Drilling A/S, Kgs. Lyngby (DK); TOTAL E&P DANMARK A/S, København (DK)

(72) Inventors: Michael Kannegaard, Gentofte (DK); John Anthony Gill, Nottinghamshire (GB); Jeanne Mia Lønstrup, Copenhagen (GB)

(73) Assignee: NOBLE DRILLING A/S, Kgs. Lyngby (DK)

( * ) Notice: Subject to any disclaimer, the term of this patent is extended or adjusted under 35 U.S.C. 154(b) by 0 days.

(21) Appl. No.: 15/771,665

(22) PCT Filed: Oct. 31, 2016

(86) PCT No.: PCT/DK2016/000041
§ 371 (c)(1),
(2) Date: Apr. 27, 2018

(87) PCT Pub. No.: WO2017/071710
PCT Pub. Date: May 4, 2017

(65) Prior Publication Data

US 2018/0320331 A1 Nov. 8, 2018

(30) Foreign Application Priority Data

Oct. 29, 2015 (DK) ..... PA 2015 00668
Dec. 23, 2015 (GB) ..... 1522856
(Continued)

(51) Int. Cl.
*E02B 17/02* (2006.01)
*E21B 15/02* (2006.01)
(Continued)

(52) U.S. Cl.
CPC ..... *E02B 17/021* (2013.01); *E21B 15/003* (2013.01); *E21B 15/02* (2013.01); *E21B 19/002* (2013.01); *E02B 2017/006* (2013.01)

(58) Field of Classification Search
CPC combination set(s) only.
See application file for complete search history.

(56) References Cited

U.S. PATENT DOCUMENTS 4,850,439 A 7/1989 Lund
5,248,003 A * 9/1993 Song ..... E02B 17/021 175/9
(Continued)

FOREIGN PATENT DOCUMENTS

GB 2041836 A 9/1980
WO WO-2014140369 A3 * 7/2015 ..... E21B 15/02
WO 2016/175657 A1 11/2016

OTHER PUBLICATIONS

International Search Report and Written Opinion for International Application No. PCT/DK2016/000041 dated Feb. 23, 2017.

*Primary Examiner* — Kyle Armstrong
(74) *Attorney, Agent, or Firm* — Carlson, Gaskey & Olds, P.C.

(57) ABSTRACT

The present invention relates in some embodiments to a bottom supported drilling unit having two drilling stations for independently drilling (or otherwise working on) two wells simultaneously from a cantilever.

23 Claims, 9 Drawing Sheets

(30) Foreign Application Priority Data

| | | |
|---|---|---|
| Dec. 23, 2015 | (GB) | 1522857 |
| Jan. 21, 2016 | (GB) | 1601175 |
| Apr. 23, 2016 | (GB) | 1607101 |
| Apr. 23, 2016 | (GB) | 1607102 |
| Apr. 23, 2016 | (GB) | 1607103 |
| Apr. 23, 2016 | (GB) | 1607105 |
| Apr. 25, 2016 | (GB) | 1607180 |
| Apr. 25, 2016 | (GB) | 1607181 |
| Apr. 25, 2016 | (GB) | 1607182 |
| Apr. 25, 2016 | (GB) | 1607183 |
| Oct. 6, 2016 | (DK) | PCT/DK2016/000036 |

(51) Int. Cl.

| | |
|---|---|
| ***E21B 15/00*** | (2006.01) |
| ***E21B 19/00*** | (2006.01) |
| *E02B 17/00* | (2006.01) |

(56) References Cited

U.S. PATENT DOCUMENTS

| | | | | |
|---|---|---|---|---|
| 5,439,321 | A * | 8/1995 | Hunter | B63B 21/502 166/350 |
| 6,047,781 | A | 4/2000 | Scott et al. | |
| 6,056,071 | A | 5/2000 | Scott et al. | |
| 6,068,069 | A | 5/2000 | Scott et al. | |
| 6,085,851 | A | 7/2000 | Scott et al. | |
| 6,491,477 | B2 | 12/2002 | Bennett, Jr. et al. | |
| 2008/0298898 | A1* | 12/2008 | Roodenburg | E02B 17/00 405/196 |
| 2013/0101357 | A1* | 4/2013 | Noble | E02B 17/0021 405/196 |
| 2014/0196948 | A1* | 7/2014 | Kannegaard | E21B 19/143 175/5 |

* cited by examiner

OFFSHORE DRILLING UNIT

FIELD OF THE INVENTION

The invention relates generally to offshore well-processing systems, in particular drilling units, and furthermore to methods of operating such well-processing systems.

BACKGROUND

Mobile offshore drilling units and offshore well head platforms are widely used in both the development and exploitation of reservoirs under the seafloor. The seafloor is sometimes also referred to as the seabed or, in this context, simply the bottom.

For so-called moderate water depths, the various types of mobile offshore drilling units include so-called bottom-supported units which rest on the seabed. In the art the term rig or drilling rig is used to signify the drilling station, i.e. equipment typically including a mast or derrick which is used to perform the drilling process. However, the terms offshore drilling rig or drilling rig are also used to signify the entire unit such as a semisubmersible, jack-up drilling unit or ship with a drilling station. Examples of bottom-supported units include bottom-supported, self-elevating units. Jack-up drilling units are typical examples of such bottom-supported, self-elevating units; they comprise a main body in the form of a hull and a number of legs adapted to be lowered towards the seabed. The hull allows the jack-up drilling units to float and sail (by towing and/or self-propulsion) to their desired off-shore location with the legs in a raised position. A so-called heavy-lift ship or barge may also be used to transport a jack-up drilling unit to or near its location and is typically preferable for long transits. Once the unit is at its intended position the legs are lowered and brought into contact with the seabed, often by driving them into the seabed to secure them in place. Further lowering of the legs relative to the hull causes the hull to be elevated out of the water. Many jack-up drilling units have the drill floor and well center positioned on a cantilever system so that the drill floor is either placed on the cantilever or forms part of a deck of the cantilever. The cantilever can be extended horizontally outwards relative to the hull (typically from the main upper deck of the hull) of the jack-up drilling unit, thus allowing the well center to be positioned outside the periphery of the drilling unit defined by the hull of the drilling unit. While most bottom supported drilling units are jack-up drilling units with a hull and three legs other configurations are possible. Single and four-legged jack-up drilling units exist in the art and the main body does not need to be floating. Fixed-height bottom-supported structures are also feasible where the main body extends from the seabed and to the desired height of elevation over the sea. The term bottom-supported as used herein also includes indirect support by the seabed (e.g. by standing on or being attached to another structure on the seabed) or resting at a position in the seabed due to upper layers of the seabed being relatively soft.

It will be appreciated that drilling operations at moderate water depths involve considerations and challenges that are quite distinct from the considerations and challenges that are associated with drilling operations at large water depths. Deep-water drilling operations are typically performed from floating drilling vessels. As the extension and retraction of the tubulars to and from the seabed at deeper water levels are extensive tasks it has been suggested to provide deep-water drilling vessels with a main and an auxiliary drilling station.

In such units, the auxiliary drilling station is designed to assist the main drilling station in the process of drilling a single well by performing tasks off the critical path, such as extending and retracting tubulars to and from the seabed.

Offshore production or well head platforms used for extracting hydrocarbons and/or other fluids or gasses from production wells are frequently fixedly installed for longer periods. They may simply rest on the seabed or otherwise be anchored or fixated at a desired position. Such platforms and others may be used for injection of water or other liquids or gasses into at least some of the wells (typically with the intent of increasing production from other wells which can be on the same platform or on another platform). The platforms frequently support or facilitate a plurality of wells and corresponding well-heads which will typically be installed on the production platform during or at the end of the drilling or well construction. In the context of a well head platform, drilling may be performed by a drilling station (sometimes also referred to as a drilling rig), having a well center, installed on the well head platform (e.g. for relatively large platforms) or, more typically, by a drilling unit placed next to the well head platform.

A plurality of wells may be processed at the same site, especially during development drilling, towards well-completion (involving drilling at least during certain stages) making the wells ready for extraction of hydrocarbon i.e. production, injection, or other functions where the well provides access to a hydrocarbon reservoir below the seabed.

The position of a drilling center (i.e. of the projection of the well center of the drilling station which is equally referred to as well-processing center) may be changed by moving the derrick and drill floor (this operation is normally referred to as "skidding") containing at least a part of the equipment responsible for drilling. On some (typically larger) well head platforms, a drilling station (typically in the form of a derrick and drill floor) may typically be arranged on rails or skids to allow the drilling station to traverse a deck of the platform and to be arranged over a well slot, i.e. the upper end of the well to be drilled or of an existing well (i.e. a previously completed well) for performing various well-processing tasks. Similarly, on a jack-up drilling unit, the derrick and drill floor is typically supported by a cantilever that can be moved forth (outwards from the hull or main body of the unit) to allow the drilling rig of the jack-up drilling unit to reach well slots on the platform. In some embodiments, the drilling station on the cantilever is arranged on skids on the cantilever to allow transverse movement of the drilling station. In some designs the cantilever and the drilling station is arranged so that the cantilever can pivot sideways or be moved sideways (relative to the hull or main body of the unit) the latter of which is typically referred to as an XY-cantilever.

When processing a number of wells, i.e. executing one or more well-processing tasks, the drilling center needs to be repositioned using the rails, skids, or cantilever, supporting the drilling station to bring its well center over the proper location for the next well when processing shifts from one well to the next. This continued repositioning takes time that increases proportionally with the number of wells to be processed. The repositioning time is effectively "non-productive time" in relation to direct well-progression even though it of course is required to progress the wells. Furthermore, challenges may arise in reaching the desired wells. A longer reach by a cantilever may reduce the maximum load that a cantilever can handle, the length of the cantilever may pose a constraint and physical structures on the platform (or drilling unit) may limit the movement of the cantilever.

When processing a number of wells, one well may be completed before moving on to the next. The well-processing steps may generally include certain sub-steps or sub-tasks, i.e. be formed of several steps carried out sequentially. Certain steps (overall or sub-tasks) may be denoted as "critical" or as being part of a "critical path", signifying that a next or later step or sub-task cannot be carried out until the critical step has been carried out. An example of a critical step is the drilling of a 16" hole before inserting a 13⅜" casing into the drilled hole.

When processing multiple wells at the same site using an offshore drilling unit, it is generally desirable to reduce the total time required to process the plurality of wells. It is also generally desirable to maintain the complexity and production cost of the offshore drilling unit low. It is also generally desirable to provide offshore drilling units that are flexible and can be utilized at multiple sites under different operational conditions. It is further generally desirable to provide offshore drilling units that are efficient yet safe in operation.

SUMMARY

In some embodiments, the invention relates a bottom-supported offshore drilling unit for performing one or more well-processing tasks on a plurality of surface-wells of one or more off-shore hydrocarbon reservoirs located below a seabed, wherein the bottom-supported offshore drilling unit comprises a main body and a cantilever. The cantilever supports a first drilling station and a second drilling station. The first drilling station comprises a first well center and the second drilling station comprises a second well center. Said drilling unit is configured to perform drilling through the first well center into a first well and well control of the first well by said first drilling station while performing drilling through the second well center into a second well and well control of the second well by said second drilling station. In this way, the drilling unit may construct two wells simultaneously from the same cantilever.

The provision of well control on both well centers allows both drilling stations to concurrently drill respective wells, i.e. none of the drilling stations is limited to merely functioning as an auxiliary drilling station for assisting the other drilling station in drilling a single well. Hence, in situations where multiple wells are to be drilled at a drill site, drilling operations on two or more wells can be performed concurrently, thus reducing the total time for processing all wells.

The provision of two or more drilling stations on a single cantilever has a number of advantages: On many bottom-supported offshore drilling platforms, the space available for cantilevers is often limited by the distance between the legs of the platform or by other structural imitations. By placing two or more drilling stations on a single cantilever, the available space is efficiently utilized, as less space is needed for independent movement of multiple cantilevers and for inter-cantilever spacing. Accordingly, the total operational space on the cantilever for each drilling station is relatively large.

Moreover, the provision of two or more drilling stations on a single cantilever allows their corresponding well centers to be placed relatively close to each other, thus allowing efficient concurrent drilling operations to be performed even at sites where the wells are located closely next to each other.

Furthermore, the provision of two or more drilling stations on a single cantilever provides a greater flexibility in sharing equipment and other resources. For example, drilling operations typically require a variety of equipment. While some of the equipment is useful to be dedicated to the respective drilling stations in order to ensure the ability to independently perform concurrent drilling operations by both drilling stations, other equipment may advantageously be shared by both drilling stations when they are positioned on the same cantilever. This allows the total costs of the drilling unit to be kept low and facilitates an efficient utilization of the equipment.

Yet further, the provision of two or more drilling stations on a single cantilever facilitates efficient communication between the operator crews of both drilling stations and allows one crew to assist the other if necessary. This way be particularly useful when dealing with critical or even emergency situations.

Embodiments of the invention are particularly useful when applied in cooperation with a well head platform where an upper part of a conductor of a surface well may be moved between a first and a second position, thus allowing the upper part of the conductor to be moved to/from the drilling center below the well center. Embodiments of such a well head platform and of process steps for operating such a platform are disclosed by co-pending patent applications PA201500668, GB1522856.2, GB1607101.1, GB1607180.5, GB1607182.1 and GB1522857.0 which are incorporated herein by reference. In this way parallel operation of surface wells using the present invention is made even more efficient. For traditional well head platforms where the upper ends of the wells are laid out in a static matrix, one drilling station of the drilling unit described herein may have to wait idle if said drilling station has finished processing a well while processing of another well by the other drilling station of the drilling unit takes longer. Once both drilling stations have completed their respective processing tasks, the cantilever may be repositioned so as to allow the drilling stations to process further wells. To this end the cantilever may be arranged movable along a direction extending from the main body of the drilling unit outwards and/or along a direction transverse to the direction extending from the main body of the drilling unit outwards. The main body of the drilling unit may have the form of a hull or a different suitable structure by which the cantilever can be movably supported.

In general, movement of an upper part of a conductor between a first and a second position involves horizontally moving the upper end of the conductor between a corresponding first and second position of the upper end. Unless otherwise specified, movement of a conductor, or a part thereof, refers, in the context of this specification, to movement of a part of the conductor extending above the seabed after the conductor has been installed in the seabed in the early part of establishing a well. Typically, the part of the conductor extending into the seabed is considered fixed after installation.

When the upper parts of the conductors can be repositioned at the well-head platform, a drilling station may proceed with the processing of a further well without having to wait for the other drilling station to finish its task. To this end, the upper part of the conductor of a well where processing by the first drilling station has been brought to the desired stage can be moved from an operational position in operational alignment with the well center of the first drilling station to a stand-by position. The upper part of another conductor can thus be moved from its stand-by position to an operational position in operational alignment with the well center of the first drilling station so as to allow the first drilling station to proceed processing the well associated with said another conductor.

In some embodiments, the offshore drilling unit is configured to be deployed at water depths of 200 m or less, such as 150 m or less, such as 125 m or less, such as 100 m or less.

While, in some embodiments, both drilling stations are configured to concurrently and independently perform drilling operations and well control of respective wells, it will be appreciated that, in some embodiments, one drilling station may also be capable to assist the well construction performed at the other drilling station e.g. by making up stands or bottom hole assemblies. In some embodiments, some functions can only be performed at one of the drilling stations (e.g. some pressure tests for the BOP). In some embodiment, one of the drilling stations may be configured to perform a first sub-task of a well construction process while the other drilling station is configured to perform a second subtask. For example, one drilling station may be configured to perform drilling tasks while the other drilling station is configured to perform well completion tasks. Hence the first drilling station may be used to drill a plurality of holes into the seabed while the second drilling station may be used to perform well completion tasks on the holes drilled by the first drilling station. Such a batch-type processing may be particularly efficient when performed in cooperation with a well-head platform that allows movement of conductors as described herein.

However, it is preferable that the drilling unit is arranged so that both drilling stations may operate independently. In some embodiments, the ability to operate independently is taken to mean that more than 50% of the tasks for construction of a well can be performed at both well centers, such as more than 60%, such as more than 70%, such as more than 80%, such as more than 90%, such as all of the tasks. In some embodiments, such task may be performed regardless of what operation is taken place at the other well center; with the exception of well incidents such as an emergency event, such as a kick where hydrocarbons from the well is at high risk of reaching the drilling unit at least until the kick is under control. Accordingly, in some embodiments, the drilling stations are substantially identical having similar or even identical capacities and equipment while, in some instances, the configurations of the drilling stations may differ. For example, one drilling station may be optimized for certain types of wells whereas the other is configured more generically or even with another specialization. Variation may also be in the lifting capacity (where a lower lifting capacity may be faster and/or cheaper) and/or pressure rating of the well control system.

A requirement of independent operation so that the operation at one drilling station does not need to consider the operation at the other drilling station (except perhaps for emergencies) will in most embodiments require a shield from dropped objects from one station entering the other. Accordingly, in some embodiments the drilling unit comprises one or more partitions separating and/or shielding the plurality of drilling stations. In some embodiments, this partition is removable allowing equipment from one drilling station to interact with the other. Examples of partitions may include a wall, a fence, a net, or another suitable shielding structure or a combination thereof.

In order to facilitate independent operation, the drilling stations preferably comprise separate rotary tables and separate hoisting systems, including separate crown assemblies, separate topdrives and separate drawworks or other hoisting equipment such as cylinders. Moreover, in many embodiments, the drilling stations may each comprise iron roughnecks and separate pipe feeding equipment for feeding tubulars from a setback area to the well center. I many embodiments it will be preferred that each drilling station comprises a dedicated setback area as this facilitates an efficient layout and efficient utilization of the setback area.

Generally well control refers to a process for maintaining the fluid column hydrostatic pressure and formation pressure to prevent influx of formation fluids into the wellbore. In many embodiments, independent operation also means that the drilling stations each comprise an independently operable well-control system comprising at least some dedicated components that are operationally independent from the correspondent components of the other drilling station. To this end, the respective well-control systems of the drilling stations may utilize separate components that are dedicated to respective ones of the drilling stations such as separate BOPs, separate diverters, separate choke-and-kill manifolds, separate trip tanks and/or separate overboard lines and that the offshore drilling unit may thus comprise sufficient well-control components for such separation. Accordingly, in many embodiments, the first and second drilling station each comprises an independently operable well control system.

Nevertheless, it will be appreciated that the two well control systems may share some components without preventing independent operation of the well control systems. While such components may also be provided as separate components, each dedicated to one of the well processing systems, at least some of these components may be shared by or temporarily dedicated to the well control systems. Accordingly, in some embodiments, the drilling unit comprises one or more components that are selectably operable in relation to the first or the second drilling station, such as selected from one or more of the group of A high-pressure manifolds of a fluid system, such as a choke and/or kill line for a well control system,
one or more mud gas separators of a fluid system,
one or more shaker packs,
one or more process pits,
one or more mud pits,
one or more mud pumps and
mud mixing equipment.

In this way capacities may be shifted between drilling stations such as for redundancy or for flexibility in maintenance. For example, the unit may comprise three pieces of a particular type of equipment where two are applied at the respective drilling stations whereas the third is being maintained or ready to replace one of the two in operation. In this way high redundancy and efficiency may be provided.

Moreover, the drilling unit and, in particular, the cantilever may comprise support facilities that can advantageously be shared by the two drilling stations, such as a common hydraulic system, shared BOP handling equipment, shared BOP test equipment, a common air supply system, a common ventilation system, common cranes, etc. The BOP handling equipment may e.g. comprise equipment for moving a BOP from a storage/maintenance position to an operational position aligned with one of the well centers.

In some embodiments, the offshore drilling unit may comprise a third, fourth or even further drilling stations. Each of these drilling stations may comprise any of the features described in relation to the first and/or second drilling stations.

The drilling unit and, in particular, the cantilever may further comprise one or more storage areas for storing tubulars and pipe handling equipment for feeding tubulars from the storage area(s) to the respective drilling stations along respective feeding paths. In some embodiments, it is preferable that the well-centers of the drilling stations may be reached by tubulars along a path that is substantial parallel to the direction along which the cantilever extends outwards from the main body of the drilling unit. In this way, the well center of the drilling station may be placed towards the distal end of the cantilever allowing the cantilever to reach wells further away from the main body while tubulars may be brought to each well center with little or no interference with the operation at the other well center. Accordingly, in some embodiments, the cantilever defines an extension direction, away from the main body, and the well centers of the first and second drilling stations are arranged on a line perpendicular to the extension direction. However, other configurations are feasible. Hence, in some embodiment, the well centers of the first and second drilling stations are arranged on a line perpendicular to the extension direction, on a line parallel to the extension direction or on a line defining an angle less than 90 degrees, such as 45 degrees, relative to the extension direction.

The term well center refers to a hole in the drill deck through which the drilling station is configured to lower tubular equipment all the way to the seabed and/or through which the drilling station can perform drilling into the seabed. A well center thus defines a downward passage extending through the drill deck through which tubular equipment may be lowered to the seabed. A drilling system comprising a well center along with the necessary equipment for drilling a well (such as hoisting equipment for lowering tubulars through the well center including its support structure and the drill floor surrounding the well center) is referred to as a drilling station. Systems or devices that are required to connect or engage with tubulars as they are lowered towards the seabed or tripping out of the well center may be considered part of the drilling station, such as a diverter or diverter housing connected below the well center, topdrive etc. Other systems that can be said to feed to the drilling operation, such as a mud system for well control (such as mud pumps, mixing, trip tanks, stand pipe, manifolds) or a control system for controlling the drilling process and/or well control, various manifolds, a pipe system for presenting pipes at (above) the well center, an iron roughneck for making of braking connections, a blow-out preventer etc. will in general also be referred to as being associated to the drilling station but a skilled person will appreciate that such systems may be brought to and from the well center during normal operation and/or located remotely from the well center and provide e.g. drilling mud via pipes and/or hoses to the well center.

A well control system includes systems and structures put in place to prevent unintentional flow of well bore fluids (liquid or gas) from open formations, i.e. a formation that is exposed to the well bore. As well construction progresses casings are typically installed (cemented) in the hole. From the drilling station two systems are typically applied so that a primary well barrier is put in place along with a secondary barrier that is to prevent unintentional flow if the primary barrier fails. In the upper end of the well (prior to setting the first casing) there is little risk of inflow of well bore fluids. Once the well construction progresses into a high pressure part of the formation there is a risk of influx or loss of well fluids. To control this flow a primary barrier in the form of mud is pumped into the well bore from the drill bit and circulated out at the top of the well carrying drill cuttings to the surface. This process is referred to as circulating mud. The weight of the mud is designed to apply sufficient pressure to stabilize the formation pressure e.g. to maintain an equilibrium. Other forms of well control are in principle feasible. As a secondary barrier a blow out preventer (BOP) is installed on the well head at the upper end of the well. BOPs are well-known in the art and are able to close off the well mechanically in case the primary well barrier is insufficient.

It will be appreciated that the drilling station may comprise additional holes or openings such as foxholes and mouse holes that may e.g. be used for building stands of tubulars but through which the drilling station cannot lower tubulars to the seabed and/or through which the drilling station cannot perform drilling into the seabed e.g. by lacking a system arranged to rotate a drill string with sufficient force such as a top drive or a rotary table and/or where there is a bottom in the hole. In some embodiments, a well center comprises a rotary table or a similar device allowing a drill string to be suspended by, or hung off in, the well center; to this end, a well center may comprise power slips or other devices operable to engage tubular equipment and to support the weight of the tubular equipment and, in particular, a string of tubular equipment extending to the seabed, so as to prevent the tubular equipment from descending through the well center.

A displaceable well center may comprise a displaceable rotary table or a similar displaceable element comprising a hole and defining a downward passage. In some embodiments, the drilling station is arranged so that equipment required at the well center for drilling can be applied at one or more (such as all) positions for a displaceable well center. For example, the top drive arranged to operate through the well center (and preferably the hook of corresponding hoisting system) may be arranged to shift with the displaceable well center e.g. by moving the crown block(s) of the hoisting system and extending dolly arms of the top drive. In some embodiments, a displaceable well center may be applied to move out of the way to allow for a different operation through the deck or redundancy by allowing a second well center to be moved under the hoisting system of the first well center (e.g. by counter movement of the drill floor by skidding the cantilever or the drilling station).

A well center suitable for drilling operations is typically associated with a mud return system using e.g. a conductor operable as a mud return conduit. Accordingly, each of the drilling stations may comprise a diverter system including a diverter housing arranged below the well center so that drill string passed through the well center extends through said diverter housing arranged for diverting e.g. blow outs to one side of the offshore drilling unit. Moreover, the drilling station comprises a hoisting system, top drive and/or other equipment configured to operate through the well center and to perform drilling operations in the seabed.

In the present context, an offshore well-processing unit is to be taken as a system for constructing, manipulating, maintaining, and/or data gathering of, or for, a well such as a well-construction system, plug-and-abandonment system, work-over system, intervention system, etc. An offshore well-processing system that is able to perform drilling of a well (including the provision of well-control and sufficient lifting capacities) is referred to as an offshore drilling unit. Accordingly, a drilling unit includes equipment for handling tubulars, for well control, and for rotating the drilling string. Embodiments of a drilling station include a well center on the cantilever of the drilling unit such that the well center may be positioned above a well head platform. Typically, a drilling station comprises a hoisting system for lifting tubulars in and out of the well center. The hoisting system may have a capacity of 250 tons or more than 250 tons, such as 500 tons or more, such as 750 tons or more, such as 1000 tons or more.

In the present context, well-processing tasks are to be taken as tasks or sub-tasks for construction, manipulating, production, maintaining, and/or data gathering of or for a well including drilling, extraction, injection, etc. Generally, drilling operations may comprise a multitude of tasks including operations such as well exploration, construction, completion, intervention, plug and abandonment etc. Embodiments of a drilling unit disclosed herein may be configured to be able to perform one, some or even all of these tasks.

According to one aspect, disclosed herein are embodiments of an offshore drilling system comprising a bottom-supported offshore drilling unit as disclosed herein and an offshore bottom supported wellhead platform. The offshore bottom supported well head platform comprises a configurable support structure for supporting at least respective upper parts of two or more conductors. For each conductor, the upper part comprises an upper end through which one or more well-processing tasks can be performed, wherein the offshore wellhead platform allows movement of the upper part of each of the two or more conductors between a first and a second position of each of the two or more conductors; said positions corresponding respectively to a first and a second position of the respective upper ends, the configurable support structure supports the two or more conductors at least in said first position, and where the second positions of a plurality of said two or more conductors are a shared second position corresponding to a shared second position of the respective upper ends of the two or more conductors, at which shared second position (a) each of said plurality of conductors may be selectively placed, and (b) the offshore bottom supported wellhead platform allows performance, by the first drilling station, through the first well center, without lateral displacement of the first drilling station or of the first well center, of a well processing task through the upper end of a conductor, of said plurality of said two or more conductors, when positioned at said shared second position, and a subsequent well processing task through the upper part of another conductor, of said plurality of said two or more conductors, when subsequently positioned at said shared second position.

Hence, in some embodiments, the drilling unit and the wellhead platform are configured to perform a well processing task by the first drilling station through the first well center and an upper part of a first conductor positioned at said second position and subsequently, without lateral displacement of the first drilling station or the first well center, to perform a well processing task by the first drilling station through the first well center and an upper part of a first conductor positioned at said second position.

In the present context, wells are to be understood as so-called surface-wells where a part of the well (once established), i.e. at least the wellhead of a given well, is located above the water level. Surface-wells are opposed to sub-sea wells with subsea trees (also referred to as wet trees, etc.). Referrals to a well or to wells throughout the present description and accompanying claims are to surface-wells unless expressly stated otherwise. A surface well may equally be referred to as an offshore surface well. The term well is used herein to refer to a well to be or a well under construction as well as to an existing well.

A wellhead platform or WHP is a structure or structures which may support the upper end (opposite of the reservoir) of the well including any superstructures, one or more well processing stations, or similar. Such a wellhead platform is typically a structure (such as a jacket or gravity based platform) resting on the seabed, ranging from very basic configurations to complex facilities. The decks of the wellhead platform are generally placed above the water and waves (e.g. above a 10.000 year wave). The wellhead platform may support one of more horizontal frames with support elements for conductors below the water typically as part of a jacket. An offshore wellhead platform may comprise one or more well-processing stations. Alternatively, the offshore wellhead platform does not comprise any well-processing stations. In such cases, well-processing tasks such as drilling may be performed by a drilling unit and, in particular, a drilling unit as described herein, placed next to the well head platform. A WHP typically fulfills one or more of the following functions in supporting a conductor: (i) shield the conductor from accidental impacts from ships and vessels, (ii) keeping the completed surface well from otherwise tipping over, (iii) provide structure where pipes can be mounted for connecting to a valve assembly or production tree (e.g. also referred to as Xmas tree) mounted on each conductor and for interfacing these pipes with various equipment or manifolds on and/or off the platform, such as pumps and storage tanks, (iv) supporting the Xmas trees so that they are substantially static relative to the platform (at least during production) as the platform and/or conductor is/are exposed to forces from current, wind and waves.

Accordingly, in the present context and throughout the entire description and accompanying claims, an offshore wellhead platform is to be understood as a structure or structures configured for supporting a plurality of conductors (once installed with wellhead platform) and a plurality of surface-wells i.e. typically the respective Xmas tree mounted on the conductor (once established). More particularly, the offshore wellhead platform is configured for supporting at least the well head and the upper part of a number of conductors. While it is preferable that the Xmas tree is substantially fixed during production it may be advantageous to allow some minor relative motions of the upper end, wellhead and/or Xmas tree when an external well processing system—e.g. a drilling station of an embodiment of the offshore drilling unit described herein—engages with the conductor or wellhead due to potential relative motions between the well processing system and the well head platform.

Typically, a wellhead platform mainly provides horizontal support, in the sense that it may absorb or transfer horizontal forces or otherwise limit the relative motion between the conductor and wellhead platform, whereas the conductor supports all or most of its vertical weight. Due to the relatively high stiffness of a conductor and the wellhead, an Xmas tree is typically sufficiently supported by the wellhead platform engaging with the conductor at one or more locations below the upper end of the conductor without necessarily engaging with the Xmas tree directly to transfer horizontal forces. The same holds for the wellhead and the upper part and upper end of the conductor. The offshore wellhead platform may be configured for engaging with the conductors at a number of appropriate (lengthwise) locations and may support the conductors in one or more suitable ways, such as (i) the conductors leaning or resting against a part of the offshore wellhead platform, (ii) the offshore wellhead platform providing horizontal support for the conductors, (iii) the offshore wellhead platform providing vertical support for the conductors and (iv) any combinations thereof.

In some embodiments, the offshore wellhead platform may after installation be rigidly fixed to the seabed or in other ways be secured, anchored, moored, connected or the like to the seabed. The offshore wellhead platform is after installation partly above sea level.

Typically, one conductor is used for each well, however, a split well head or similar may support more than one well in each conductor.

In the present context and throughout the entire description and accompanying claims, a conductor is to be understood as a conductor pipe or conductor casing (forth only referred to as conductor) for a surface well. For surface wells, the conductor extends from below the seabed to a wellhead (once installed) located above the water level. The conductor is typically set before the actually drilling into the seabed is performed. It is usually set with special pile-driving or spudder rig but, alternatively, a drilling station may be used. The conductor provides structural support for the well, the wellhead and completion equipment; it often provides hole stability for the initial drilling stage. For a surface well, a conductor performs the function of effectively "transferring" the seabed to a position above the water level so that the well may be constructed through the conductor at this position, as opposed to on the seabed as would be the case for a subsea well. The wellhead is installed at the upper end of the conductor and casing strings are installed through the conductor as drilling of the well progresses and the well is constructed. The wellhead is often installed so that it rests on the upper end of the conductor. However, a wellhead may also be installed on the upper end of a casing (often a surface casing) installed in the conductor pipe and extending above the upper end of the conductor pipe (typically less than 2 meters). This section of casing is rarely relied upon to be engaged for structural support of the upper part of the well (x-mas tree and wellhead) but it will be appreciated that the configurable support structure may support the upper part of a conductor by engaging with a casing extending out of the upper end of the conductor. Some casings are hung off the wellhead whereas other casing strings may hang from lower levels of the well. The conductor typically has a diameter between 18" and 30". Typically, one conductor is used for each well and when the well is completed the conductor hosts a set of concentric casings strings. However, a split wellhead or similar may support more than one well for each conductor.

Such conductors for drilling units and/or wellhead platforms being supported by the seabed are commonly referred to as non-flexible conductors (even while being flexible to some extent). A very typical example of such conductors includes e.g. regular relatively rigid steel pipe or similar. Alternatively, the conductors may be relatively rigid plastic, polymer, titanium, carbon fiber, aluminum, etc. conductors. In principle, any material with suitable properties may be used for the conductors. However, steel pipe have proven to be very suitable. In some embodiments the conductor is made from a single layer material in the longitudinal direction as opposed to e.g. a spiral wound pipe. In some embodiments the conductor is made from multiple concentric layers.

Such non-flexible conductors are opposed and very different to so-called flexible pipes or connections used with deep-water wells, sub-sea wells, etc. or even used with surface-wells located on a floating platform, i.e. a platform or unit that is not fixed to or supported by the seabed. Such flexible pipe is typically made from helically wound metallic armour wires or tapes combined with concentric layers of polymers, textiles, fabric strips and lubricants.

A conductor is typically installed as the first component for a well to be drilled into the seabed towards a reservoir and, after well completion, a valve assembly or production tree (e.g. also referred to as Christmas tree, Xmas tree, etc.) is typically mounted on the wellhead of the conductor, the well head being located above the water level while being supported by a wellhead platform, drilling unit, or similar. The wellhead platform typically supports the Xmas tree and/or the well head in-directly (by supporting the conductor) or directly by engaging physically to support horizontal forces. As the x-mas tree and wellhead will move as the upper part is move and some embodiments are arranged to support movement of the conductor after completer, the wellhead platform may further be arranged to support movement of the wellhead and/or x-mas tree between a first and second position as the corresponding conductor is moved between a first and second position.

In certain embodiments, the respective upper part of each conductor comprises a part or segment made of a more flexible material (than what the rest of the conductor primarily is made of, e.g. steel, etc.) and/or being flexible in another manner. Flexibility may e.g. be provided by varying the properties and/or geometry of the conductor at certain parts.

Upper part (such as the upper end) of the conductor is to mean the part of the conductor where a well processing station or drilling station will connect to the conductor (when performing one or more well processing tasks) and where a production tree (also referred to as Xmas tree) and wellhead are installed or to be installed. The upper part of a conductor refers to a portion of the conductor above the seabed that includes the upper end of the conductor and that extends from the upper end downwards The upper part of a conductor may include a part of the conductor that is received by a so-called wellhead deck (when present) of the wellhead platform. The wellhead deck may also be referred to as wellhead platform deck, cellar deck, well-bay area, or well slot area. The upper part of a conductor may in addition or alternatively include a part of the conductor that is received by a deck (when present) being located beneath the wellhead deck.

The upper part moves as the conductor is moved between a first and a second position of the conductor. The upper part is supported by the platform via one or more elements (e.g. guides or locking elements) of the support structure either engaging with the conductor or otherwise limiting the range of motion of the conductor. The one or more elements of the support structure may engage with the conductor at the upper part or at one or more points below the upper part. The upper part include (and may even be limited to) the upper (most) end where the opening of the conductor for receiving components for the well (such as a wellhead) is located. In some embodiments, the upper part extends below the upper end, such as the part of the conductor below the upper end where the shape conductor remains substantially constant as the conductor is moved between positions. In some embodiment the upper part extends below the upper end of the lowest element of the support structure that is configurable. In some embodiments, the upper part further extend to and include the elevation of the lowest mechanism for causing (either solely or alone) a movement of the conductor between a first and second position and/or to the elevation of the lowest configurable support element.

In some embodiments, the upper part extends 40 meters below the upper end or less, such as 20 meters or less, such as 10 meters or less, such as 5 meters of less, such as 2 meters of less, such as 1 meter or less, such as 50 cm.

The upper end and the upper part for movement purposes as described throughout is to be regarded as the present upper end and upper part, respectively, when movement takes place. So if an upper part of a conductor e.g. is cut away during operation, the resulting new upper end and new upper part will be regarded as the upper end and upper part, respectively, in relation to subsequent movement. However, in some embodiments the upper end is regarded as the position at which the conductor receives a well head.

Accordingly, movement of a conductor may involve moving the present upper part and upper end followed by cutting away a part of the conductor whereby subsequent movement of the conductor will involve movement, as described, for the new upper part and new upper end of the conductor. It is to be noted, that the old upper part may, and typically will, overlap with the new upper part whereas the new and old upper end will be different.

Throughout the description and accompanying claims, unless expressly stated otherwise, movement of a conductor is to be taken as moving the wellhead (and thereby the upper end) and/or the upper end (without a wellhead attached). This movement may comprise deflecting, swaying, flexing, bending, or the like a part of the conductor above the seabed such as an upper part of the conductor. A conductor in this context is (once installed) substantially fixed at or near the seabed. Typically, movement of the conductor is limited to movement of the part of the conductor that is located above the seabed or even limited to movement of the upper part of the conductor where the position of the conductor at the seabed remains fixed. Movement of a conductor is to be understood to equally include movement of conduits such as casings or tubulars (even when/if cemented), when such are comprised by the conductor. Basically, the conductor may be moved through all the stages from the initial conductor (e.g. conductor pipe only) to a conductor in a completed stage e.g. with an established well comprising a valve assembly or production tree and a wellhead.

The support structure is the structure of the well-head platform for supporting conductors. The support structure of the wellhead platform is formed at least by elements of the wellhead platform accommodating or engaging with the conductors, such as openings through one or more decks, fasteners, locking and/or securing mechanisms. A conductor may curve from the seabed to the upper end of the conductor in which case the curve is typically imposed on, or maintained for, the conductor by the wellhead platform via the support structure. A configurable support structure is configurable in the sense that it provides support for several conductors in a number of respective positions of the respective upper parts of the conductors and allows for movement between the positions. The support structure typical comprises elements that are substantially static at or near the seabed.

In the present context and throughout the entire description and accompanying claims, a first and a second position of a conductor corresponds to a respective first and a second position of the upper end of the conductor and a shared second position of a plurality of conductors also corresponds to a shared position of the respective upper ends of the conductors.

Different positions of the upper part imply that the conductor takes a different curve from the seabed to the upper end in each of these positions. In some embodiments some or all of the elements of the configurable support structure (i) move with the conductors (apart from openings in decks), (ii) allow the movement, (iii) work in pairs so that some elements hold the conductors in their respective first positions whereas other elements hold the conductors in their respective second positions, and (iv) comprise a combination of such elements. The elements are in some embodiments located in relation to one or more decks or other horizontal structure. This may be advantageous as the structure holding the elements may also provide structural strength to the wellhead platform. However, the configurable support structure may also be formed by elements distributed vertically without relation to specific deck structures. In the present context the configurable support structure is mainly discussed in relation to embodiments having an opening in a deck and optionally elements engaging with the conductor adjacent to (typically just below) the wellhead deck. In some embodiments a conductor may be engaged, e.g. after completion be inserting wedges between a deck (e.g. wellhead deck) and the conductor. The configurable support structure may also comprise deck inserts that prevent movement away from a position of the upper end. While these elements may form the entire configurable support structure it is to be understood that they are in many embodiments only a part of the configurable support structure as this further comprises further elements above and/or below the wellhead deck.

The configurable support structure is generally a part of the wellhead platform suitable for supporting conductors. Accordingly, when a configurable support structure is said to comprise a conductor in a particular position this refers to a situation after installation of the conductor where the configurable support structure is suitable for supporting the conductor in that position. For wellhead platforms which are generally divided into a topside and leg structure (e.g. a jacket or column) the configurable support structure may be part of the topside, leg structure or both.

In some embodiments, the first position of a conductor is at least one member selected from the group consisting of a parking, a storage, an injection, and/or a production position. Accordingly, in some embodiments, the first position for a conductor may be regarded as a state for which the wellhead platform is arranged to support the conductor when production is carried out from the reservoir. Accordingly, in some embodiments, the wellhead platform is arranged to support the conductors at different first positions simultaneously, i.e. in the first positions have non-overlapping positions of the upper ends. It is noted that during production from a reservoir, individual wells may have different functions so that a well drilled through one conductor may produce while other wells performs other functions such as injecting gas or liquids during production from the reservoir.

The second position of the conductor may be a well processing and/or drilling position. It should be noted that a given position may be one or more of the listed members as well as any possible combinations thereof. In the present context and throughout the entire description and accompanying claims, a second position of a conductor is in general a position where a well processing task may be performed through the upper end of the conductor. More specifically a second position is a well-processing and/or drilling position, where a well-processing position is a position where any suitable well-processing task may be performed.

In some embodiments, the offshore wellhead platform comprises at least one mechanism for moving the upper part of conductor between its first position and a shared second position. This mechanism could e.g. be mechanical or hydraulic push or pull, a rack and pinion drive, winch-wire, or any other suitable mechanisms moving, shifting, etc. the conductor between the first and second position.

In some embodiments, the shared second position of the upper ends is located away from the wellhead platform (e.g. with one of the drilling stations) from which the upper end of a conductor may be moved onto the wellhead platform for support at a first position. In most embodiments, the shared second position is provided on the wellhead platform, so that in one embodiment the configurable support structure provides said first position and second position for each of the two or more conductors, such as said configurable support structure supporting each conductor in the shared second position, such as said configurable support structure supporting each conductor from said first to said shared second position. The shared second positions are then provided at a working center or working center zone. Accordingly, the well head platform is arranged to align with a well center of the first and/or second drilling station.

Due to positioning tolerances, it may not always be feasible to accurately position the well centers of the drilling unit above a specific position but rather only within a certain area or zone. Moreover, during the performance of a well processing task the wellhead platform and/or the drilling unit may be subject to different motions due to wind, waves and currents. Accordingly, this may impose a relative motion between the conductor and the well head platform. To allow for such motions, additional tolerances may be desirable, e.g. so as to reduce the risk that a conductor, when operated from a second position with its upper end aligned with a well center, will not clash with the wellhead platform or other conductors. Accordingly, in order to accommodate one or both of the above types of tolerances, it may be desirable to allow for some flexibility when choosing the second position to which a conductor is moved.

Accordingly, in some embodiments, in order to account for position tolerances of the drilling unit, the configurable support structure is configured such that the shared second position may be selectively located/chosen within a predetermined offset zone. In this way the upper end of a conductor may be moved from a first position to any position within the predetermined offset zone so as to allow alignment of the upper end with a well center of a well processing system.

Hence, for the purpose of the present description, an offset center zone defines an area, e.g. in a horizontal plane, within which the second position of an upper end of a conductor may be located, i.e. a zone within which the upper end of the conductor may be moved so as to sufficiently align the upper end with a well center of the drilling unit. The configurable support structure may further define a safety zone so as to allow for safe operation when the conductor is operationally coupled to the drilling unit. Hence, the configurable support structure may define a working center zone that comprises an offset zone, which accounts for tolerances in the positioning of the drilling unit, and/or a safety zone, which accounts for possible relative lateral movements of the wellhead during operation. The working center zone may also be referred to as a drilling center zone. The shared second position may be chosen within the working center zone and, in particular, substantially anywhere within an offset zone comprised within the working center zone.

In some embodiments, the plurality of conductors are arranged or organized in at least two groups or clusters, wherein each group or cluster comprises at least one (e.g. a plurality of) first position and at least one (e.g. a plurality of) shared second position shared by the conductors of the cluster. Each group or cluster (during a drilling, completion or other well-process) may be associated with its own at least one well center of an offshore drilling unit. Hence, in the present context and throughout the entire description and accompanying claims, a cluster is a grouping of a plurality of first positions (e.g. comprising a conductor at least at certain points in time) for which the configurable support structure supports and enables or facilitates moving a conductor from each of the first positions of the cluster to one or more shared second positions where each of the shared second positions is shared by all first positions of the cluster. In some embodiments, one or more first positions are reachable by two or more, such as all, conductors in a cluster so that the upper end may be placed in any of the reachable first positions of the cluster. I.e. a conductor may be moved between all (reachable) first positions in a cluster and a conductor can be moved to the shared second position(s) of the cluster from all (reachable) first positions of the cluster. In some embodiments, a cluster is to be understood as being associated with at least one shared second position or working center zone. A first position may e.g. be part of more than one cluster. A conductor of a cluster at a first position may e.g. be movable to a shared second position or working center zone of another cluster. It will be appreciated that typically only a single conductor may be positioned at the shared second position at any one time, but different conductors may selectively be moved from respective first positions to the shared position.

Each well center of the drilling unit may be positioned (e.g. by repositioning the cantilever) such that it is associated with a respective shared second position of a cluster of first positions. In the present context and throughout the entire description and accompanying claims, work center position, or simply work center, of the wellhead platform is to be understood as a position for which the wellhead platform is arranged so that the well center of a drilling station may be placed above or on the wellhead platform to perform well processing tasks through an upper end of one or more conductors (supported by the wellhead platform). For a cluster of conductors arranged in relation to a (shared) second position (or a zone of (shared) second positions), the upper end of the conductors are arranged to be aligned with a well center when the conductor is in its second (shared) position thus defining a work center position for the wellhead platform. In some embodiments, the work center position is the vertical projection of the well center of a drilling station.

BRIEF DESCRIPTION OF THE DRAWINGS

FIG. 1 (*a-d*) schematically illustrates an exemplary embodiment of an offshore drilling unit and an offshore well-head platform.

DETAILED DESCRIPTION

Various aspects and embodiments of offshore drilling units and methods of their use as disclosed herein will now be described with reference to the figures.

When in the following relative expressions, such as "upper" and "lower", "right" and "left", "horizontal" and "vertical", "clockwise" and "counter clockwise" or similar are used, these refer to the appended figures and not necessarily to an actual situation of use. The shown figures are schematic representations for which reason the configuration of the different structures as well as their relative dimensions are intended to serve illustrative purposes only.

Some of the different components are only explicitly disclosed in relation to a single embodiment of the invention, but they are meant to be included in the other embodiments without further explanation.

Figure 7:
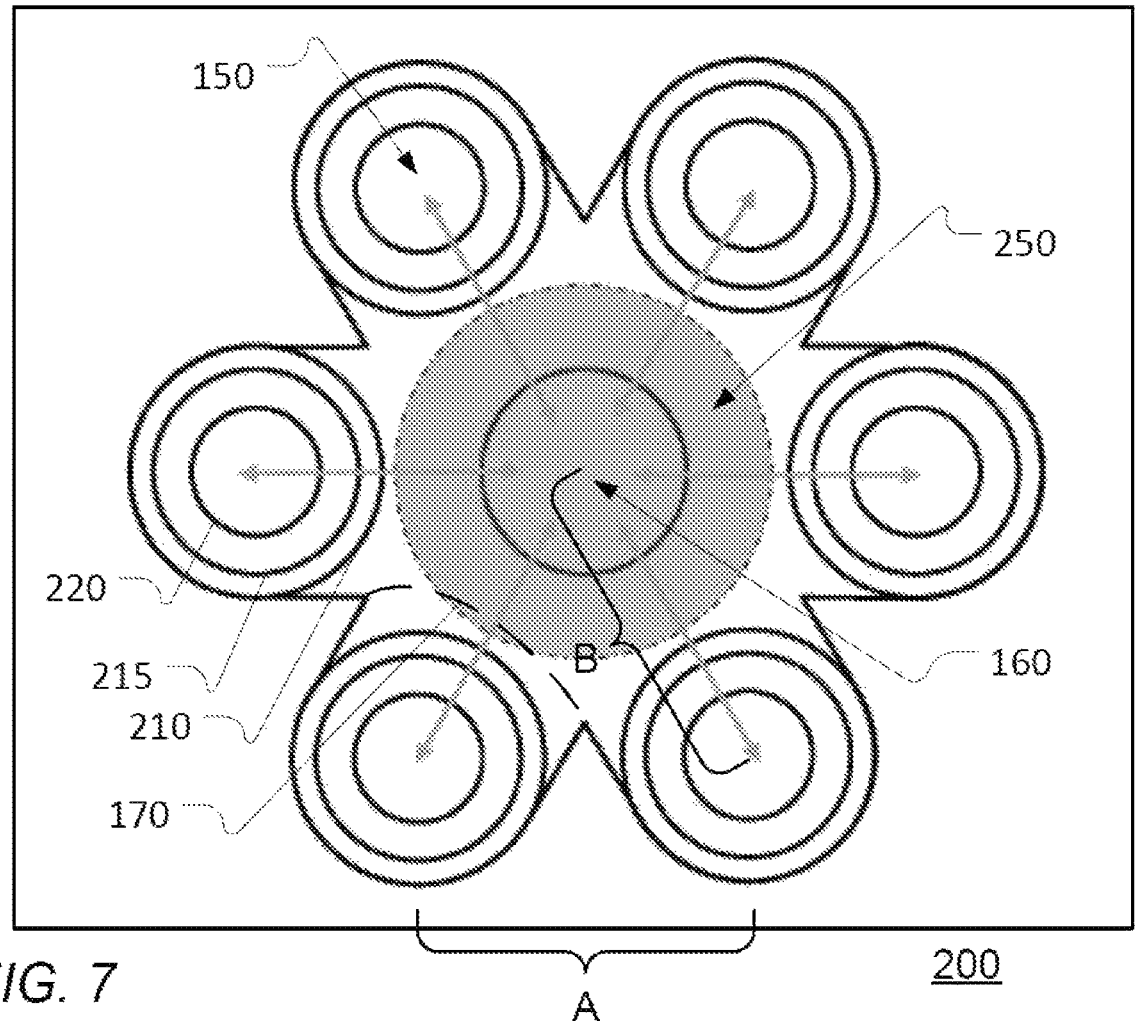
FIGS. 7 and 8 schematically illustrate embodiments of a configurable support structure as described in co-pending patent applications PA201500668, GB1522856.2, GB1607101.1, GB1607180.5, GB1607182.1 and GB1522857.0.

FIG. 1(*a-d*) shows parts of an offshore drilling unit 400 and parts of a well-head platform 100 comprising a configurable support structure 200, e.g. as explained in the above mentioned patent applications and in relation to FIG. 7. In particular, the configurable support structure supports the conductors and allows each conductor to be moved between a first position and a second position. The configurable support structure (or at least a part thereof) may at least in part be formed by, or even coincide with, a well-head deck.

Shown are also a number of conductors 210 of a number of surface wells 300 where a production tree 420 or the like is located on a well-head of each of the wells.

In some embodiments, at least one suitable mechanism is provided on the offshore well-head platform 100 and/or on the offshore drilling unit 400 for moving a conductor 210 between a first position and a second position.

A cantilever 430 of the offshore drilling unit 400 supports two drilling stations 410 with two adjacent derricks 513. The derricks are formed as two separate structure each carrying the load of one of the hoisting systems. Tubulars are stored horizontally on a pipe deck 514 provided on the cantilever towards the proximal end of the cantilever while the drilling stations are arranged towards the distal end of the cantilever, with respect to the main body of the drilling unit. As mentioned above, the drilling stations 410 may work fully independently but in some embodiments may be able to cooperate for one or more functions. In this context, collaboration is taken to mean that equipment of one drilling station is applied as part of the process that is performed at the other drilling station. Each drilling station comprises a well center 430 and each drilling station comprises a hoisting system and a well control system.

The port and the starboard side drilling stations are each connected to one of the surface wells through their respective BOPs 512 and via respective high pressure risers 519, also referred to as conductors. The well head platform 100 with a configurable support structure 200 (discussed in relation to FIG. 7 below) supports the conductors 210 of the surface wells.

Figure 1A:
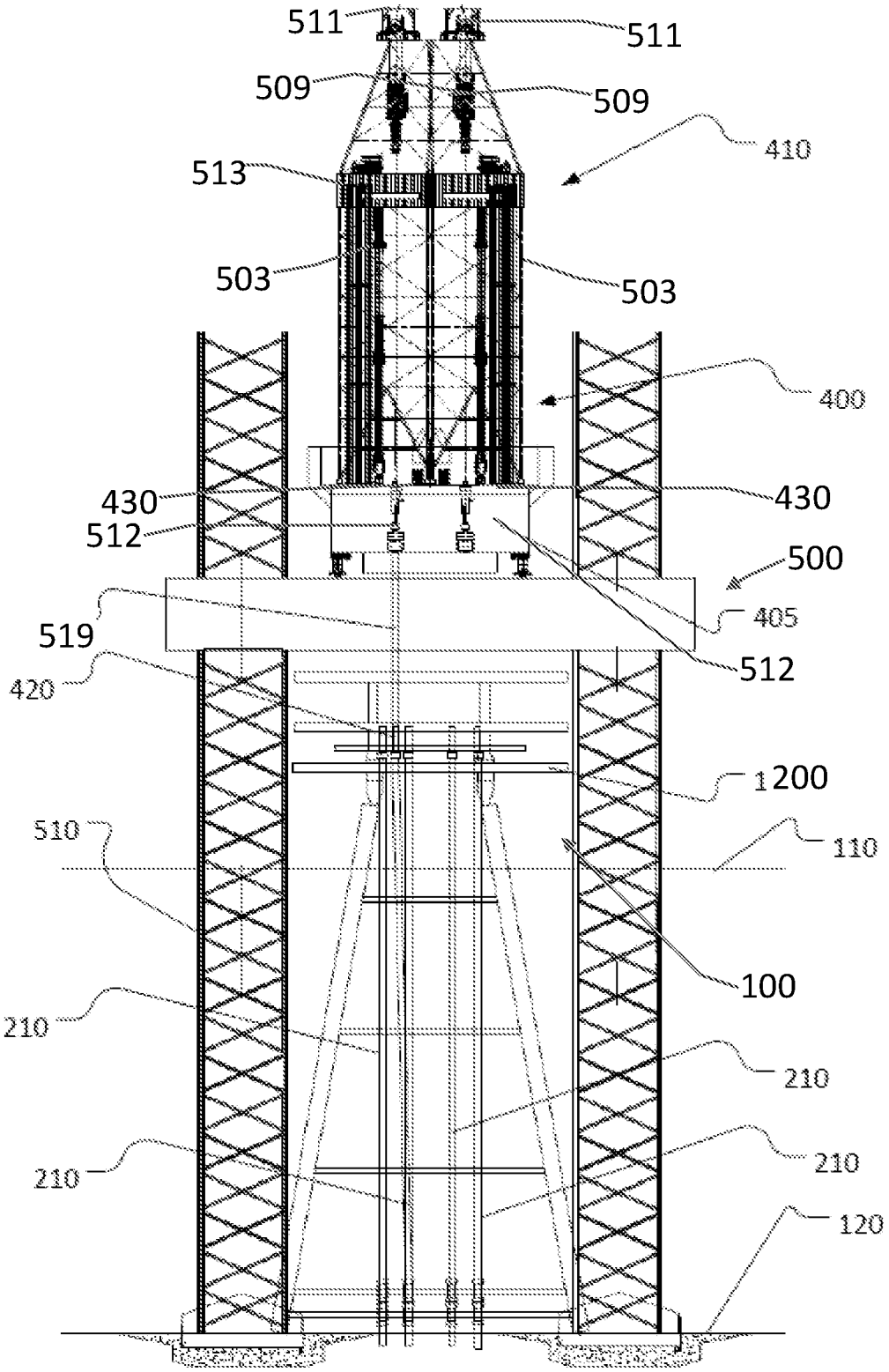
FIG. 1*a* shows a front view.
Figure 1B:
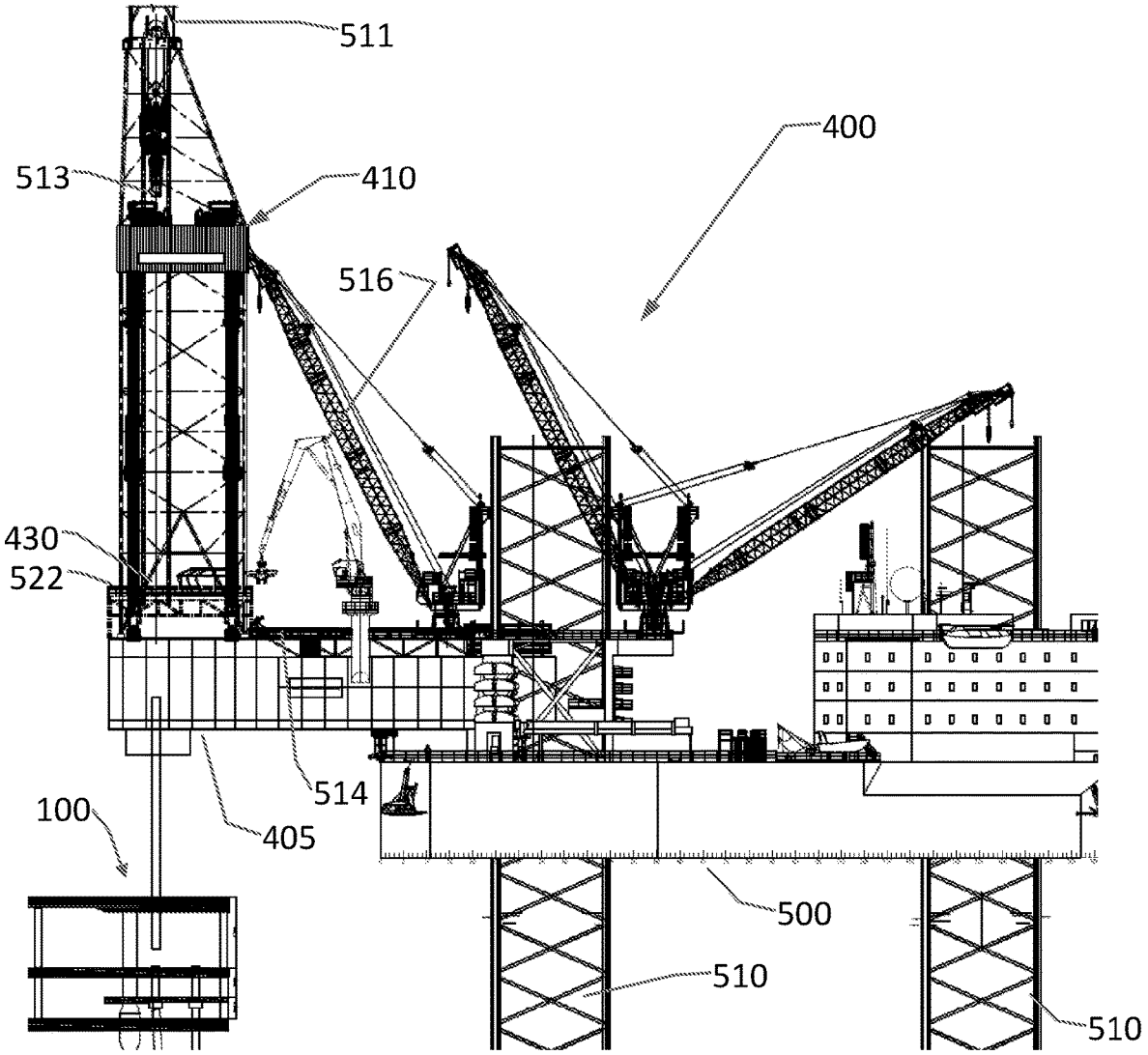
FIG. 1*b* is a side view.
Figure 1C:
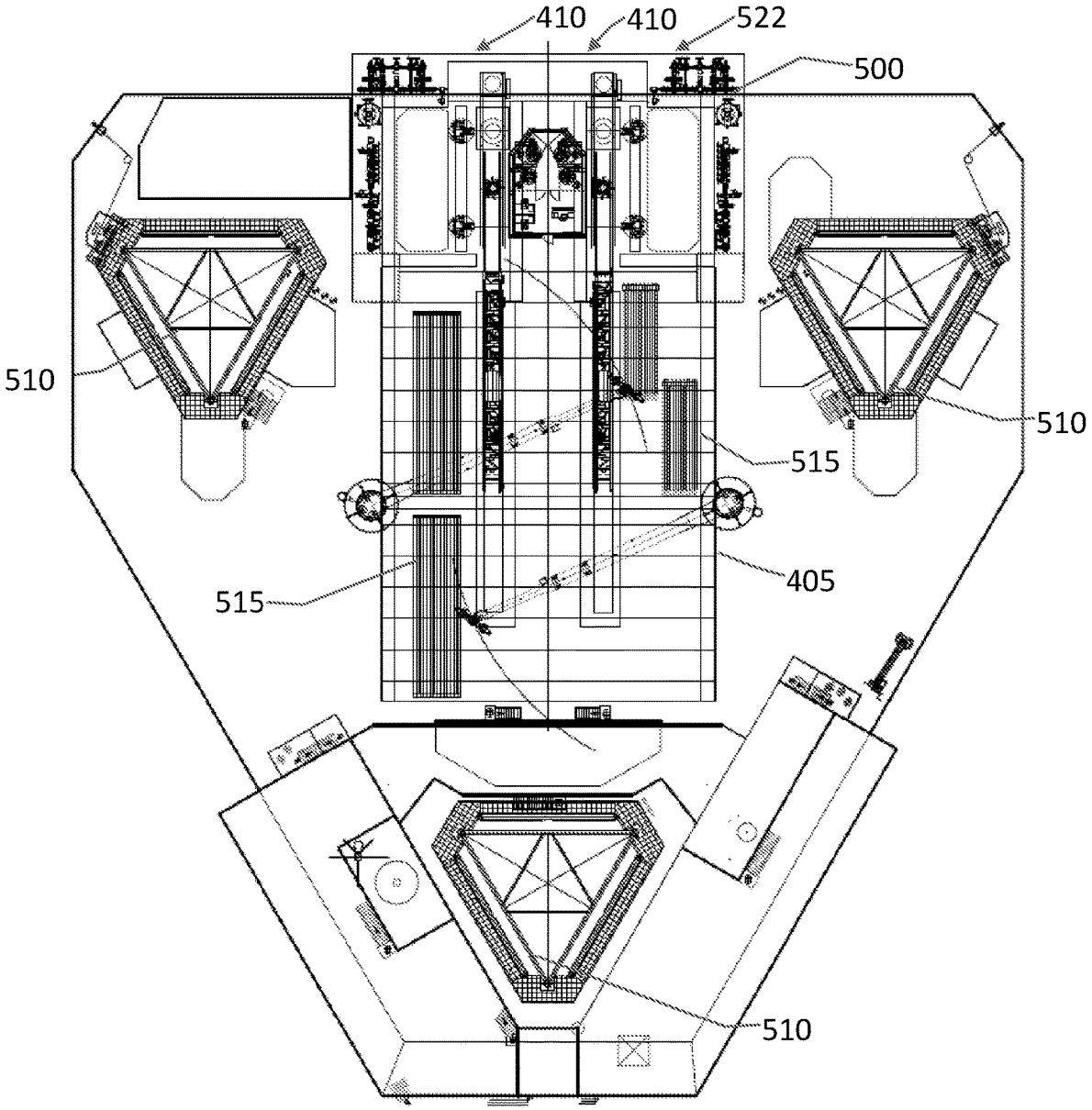
FIG. 1*c* is a top view.
Figure 1D:
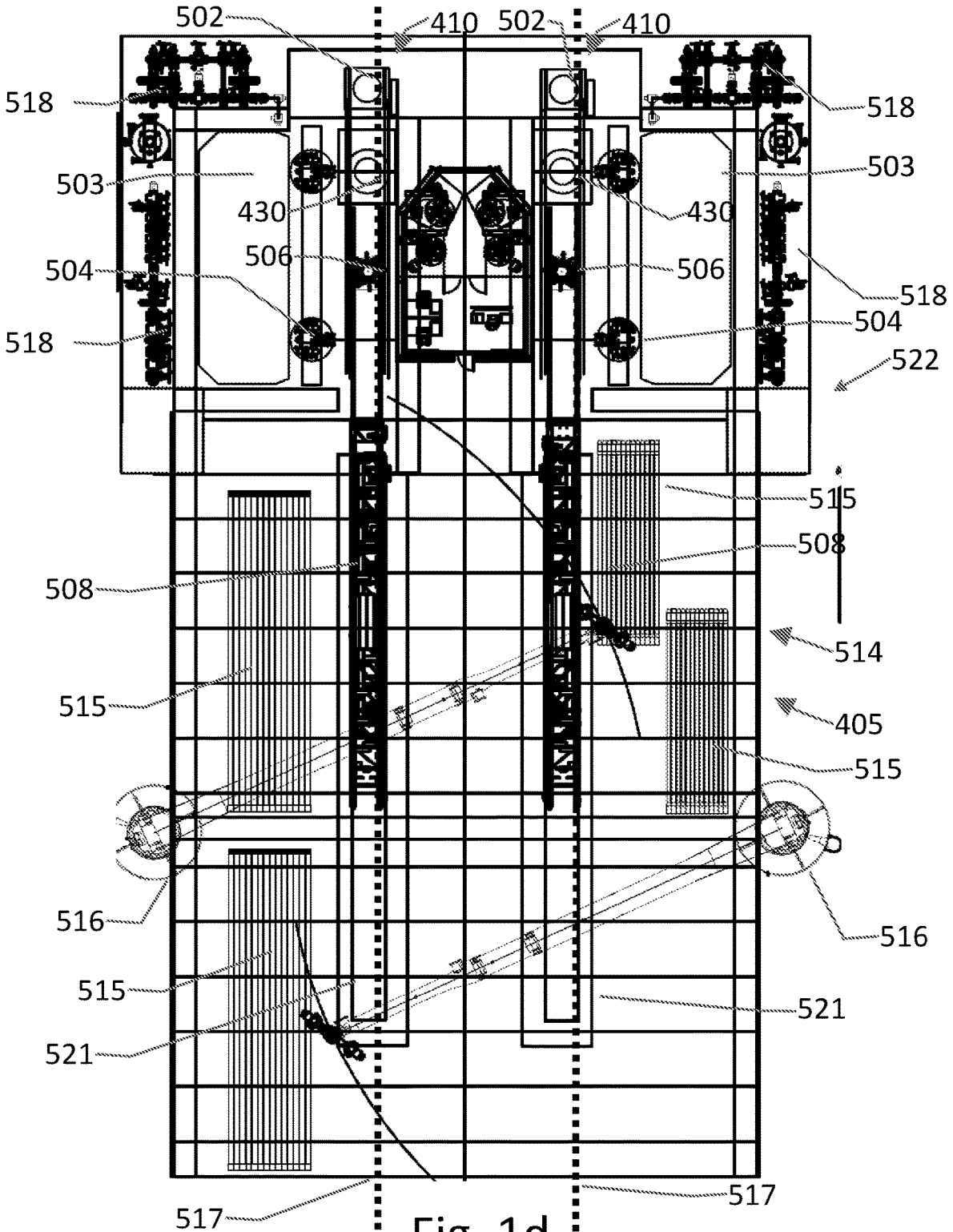
FIG. 1*d* is an enlarged top view of the cantilever shown in FIG. 1*c;*

FIG. 1*a* schematically illustrates a front view of the (aft) of a three legged jack-up drilling unit 400 and of a well-head platform positioned in from of the aft end of the jack-up drilling unit. FIG. 1*b* schematically illustrates the corresponding side view of FIG. 1*a*, FIG. 1*c* schematically illustrates a top view while FIG. 1*d* is an expanded top-view of the cantilever 405. The jack-up drilling unit 400 comprises a main body in the form of a hull 500 that is elevated above the water level 110 and supported by legs 510 which in turn are supported by the bottom 120.

The jack-up drilling unit comprises a cantilever 405 that can be moved outwards relative to the hull towards the rear of the jack-up drilling unit. In some embodiments the cantilever may also be displaced in a transverse direction, thus providing a so-called x-y cantilever. The jack-up drilling unit comprises two drilling stations 410 positioned at a distal end of the cantilever. To this end, the jack-up drilling unit comprises a support structure formed by a single derrick 513 supporting two crown blocks 511 suspending respective topdrives 509 over respective well centers 430, i.e. the jack-up drilling unit comprises two hoisting systems. Each hosting system further comprises drawworks (not shown in FIG. 1*a*); it will appreciated, however, that another type of hoisting system may be used, e.g. a hydraulic hoisting system. In general the support structures of the first and second drilling stations may be formed by any suitable support structure suitable for supporting the part of the hoisting system needed over the well center as well as the necessary loads of equipment raised in and out of the well. Suitable support structures may be a joint derrick, two adjacent derricks, two separate derricks, a joint mast such as with well centers on the same side of the mast or with the well centers placed on opposite sides, two masts, a derrick and one mast, one or two towers, or a combination thereof. A joint or adjacent derrick or mast may have the advantage that a more compact total layout may be obtained, that equipment may more readily be shared between the drilling stations, that the total steel structure or mast may be reduced relative to two separate structures and that controls may be closer together providing easier oversight of operations in both drilling stations. On the other hand two separate derricks or masts may facilitate easier separation with reduced risk of interference between the drilling stations and reduces the impact of vibrations induced by one drilling station to be propagated and potentially interfere with drilling operations at the other drilling station. Such interference could include limitations of what can be performed at one drilling station due to the operation being performed at the other drilling station e.g. when there is a risk of dropped objects or hydrocarbons on deck. As noted above, some embodiments comprise one or more partitions to separate the drilling stations.

Each of the two drilling stations is operable to operate independently on high pressure sections of a well (i.e. at depths where well control is required to ensure that drilling fluid is not pushed into the formation or well fluids enter the well bore). Hence, generally, well control of a well involves well control of at controlling at least a high pressure part of the well. To this end, each of the two drilling stations comprises an independently operable well control system, typically via blow-out preventers (BOP) 512 which may, in their operational position, be located inside the cantilever under the respective well centers. As shown in FIG. 1*a*, the drilling stations of this embodiment are equipped with surface BOPs 512 and FIG. 1*d* shows (typically high-pressure) manifolds 518, e.g. for a standpipe and for a kill and choke system for the BOP which are typical parts of a mud-based well-control system well known in the art. Typically, further components of such a well control system, such as mud pumps, mixers, shakers and/or mud cubes, are placed inside the cantilever or on/within the main body of the drilling unit.

In FIG. 1*a*, one of the drilling stations is shown connected to one of the surface wells through the corresponding BOP 512 and via a corresponding high pressure riser 519. The well head platform 100 with a configurable support structure 200 (discussed in relation to FIG. 7 below) supports the conductors 210 of the surface wells.

Figure 2:
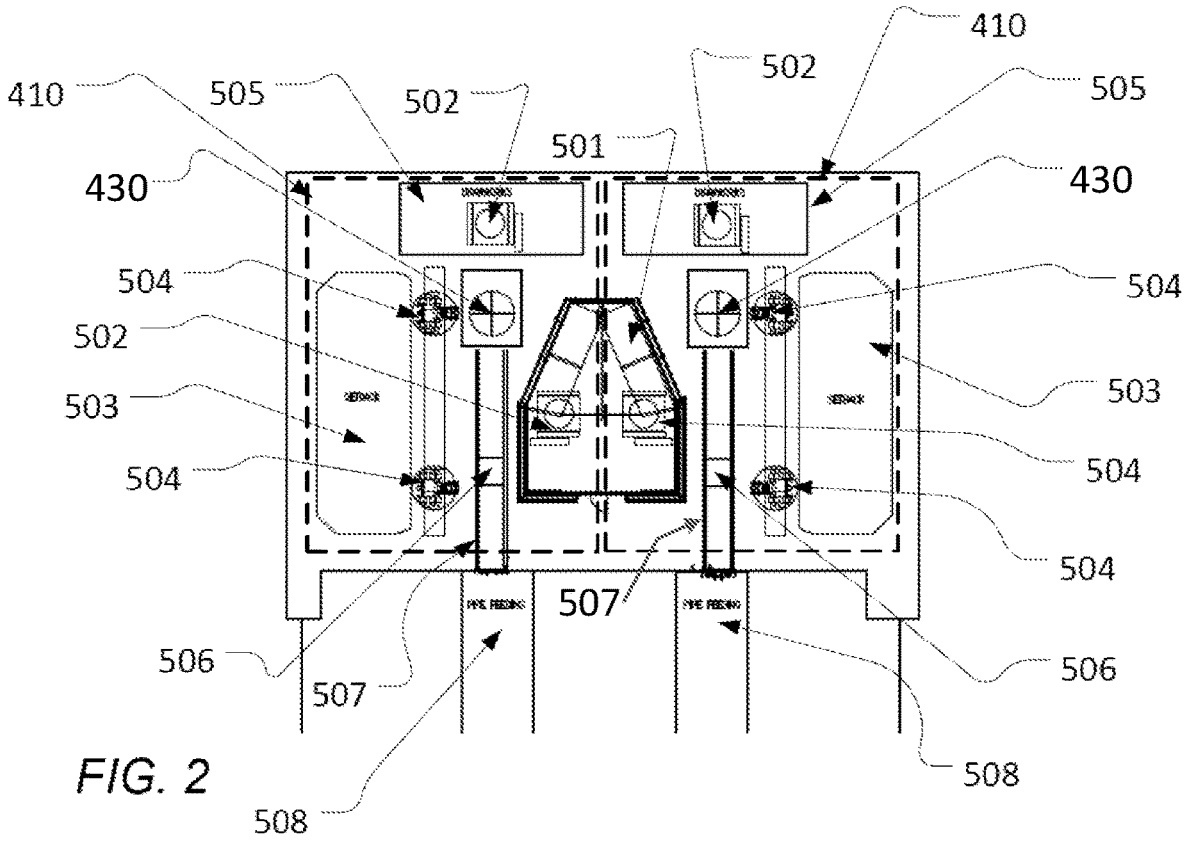
FIG. 2 schematically illustrates a top view of the two drilling stations of the embodiment of FIG. 1.

Typically an extensive number of tubulars are required to efficiently drill wells into offshore hydrocarbon reservoirs, such as drill pipe, drill collars and casings. Before assembly with the string to enter the hole (i.e. the well under construction) or into stands of two or more tubulars (typically stored vertically in a setback 503 ready to enter the hole), such tubulars are typically stored in one or more or pipe storages 515 which may hold horizontal and/or vertical pipes. In the present embodiment, horizontal pipe storages 515 are laid out on the cantilever, e.g. in the form of one or more storage areas for horizontal storage 515 on the pipe deck 514 of the cantilever 405. In FIG. 1*c-d* the pipe storages are indicated by horizontally stored pipes 515. In some embodiments, the two drilling stations have assigned respective, separate pipe storages at least for some type of pipe e.g. drill pipe or casing. Separate pipe storage (e.g. storage on starboard side of the cantilever stores tubulars for the starboard side drilling station and vice versa) may be preferable as it may provide for less interference between the operations at each drilling station. In order to bring the tubulars to the well center from a pipe storage some embodiments of the offshore drilling unit are arranged to provide first and second paths for providing tubulars from the respective pipe storage to the first and second well centers from one or more pipe storage, wherein one or more sections of said first path are separate from the sections of the second path. In many embodiments, separate paths between the pipe storage to the respective drilling station increase the likelihood that operation in one drilling station prompting the transport of tubulars to this drilling station will not be interrupted due to tubulars being transported to and from the other drilling station. In some embodiments, the one or more sections of separate paths comprises paths from pipe storage external from said drilling stations and into the first and second drilling stations respectively. For example, in the present embodiment in FIG. 1*a-d* the drill floors of the drilling stations 410 are located on the drill floor deck 522 raised relative to the pipe deck 514. Two catwalks 521 are each aligned with a well center 430 (note that the FIG. 2 provides an expanded view of the drill floor deck). To this end, pipe deck cranes 516 are arranged to service the catwalk machines 508 by taking horizontally stored pipes 515 to and from the catwalk machines which can travel along their respective catwalks and present the pipe to a respective pipe racker 504. The pipe racker raises the pipe to vertical for further transport within the drilling station 410 (indicated by the dashed squares in FIG. 2). For example, pipe rackers 504 may be operable to receive pipe sections, assemble them into stands of two or more pipe sections (e.g. using a foxhole 506) and store them in an associated setback area 503. The same or a different pipe racker may subsequently pick up stands of pipes from the setback 503 and present it to the hoisting system at the well center 430. Accordingly, the paths marked by the dotted lines 517 along each catwalk machine 508 and onto the drill floor of each drilling station are separate from each other. Several machines may be applied to provide this pipe path which may be similar to the machines applied to bring tubulars from the pipe storage to the drill floor on a conventional cantilever. Accordingly, in some embodiments, the separate paths from pipe storage to drilling station may comprise one of more of the group of:

- a pipe feeding/transport machines, e.g. a catwalk machine or a conveyor,
- a pick-up/lay-down system (PLS) or pipe racking system (PRS), such as a V-door machine,
- a tugger,
- a pipe deck pipe handler (PDPH), such as a pipe deck crane, e.g. a knuckle-boom crane or an overhead crane.

In some embodiments (such as those shown in FIGS. 2-5 and some embodiments of FIG. 6), the pipe transport machine, such as a catwalk machine 508, may traverse to present tubulars at the well center such as via the rails 507.

Each drilling station further comprises a respective iron roughneck machine 502.

FIG. 2 is an expanded view of the drilling stations and drill deck of the embodiment of FIG. 1*a-d*. FIGS. 3-6 are alternative layouts for the drilling stations.

The layout of FIG. 2 is designed with a joint driller's cabin 501 for controlling the first and second drilling stations 410. Typically, each drilling station will have a designated operating station including a dedicated operator's seat and man-machine-interface to the respective control system of the corresponding drilling station. In some embodiments, the operating stations are separated by a dividing wall so as to reduce the risk for miscommunication with the respective operator teams. However, in some embodiments a single operating station may be switched between drilling stations. In some embodiments the drilling station is remotely operatable such as from onshore. As noted in relation to the support structure, it may be preferable to have the controls close to one another although it may also be preferable to enhance independence e.g. by shielding the operation from each other (e.g. by a wall). Separating the driller's cabin for the first and second drilling station as in FIGS. 3 and 4 reduces the risk of interference between the operations at the two drilling stations.

Figure 3:
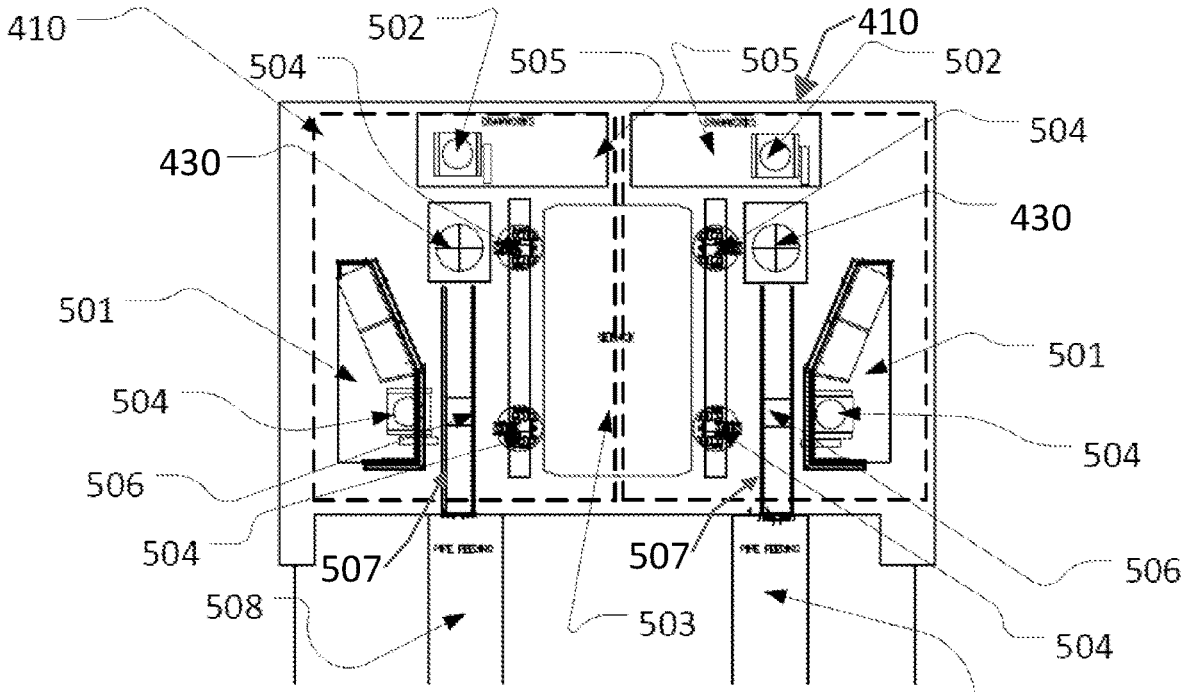
FIG. 3-6 schematically illustrates a top view of an alternative layout of the two drilling stations of the embodiment of FIG. 1.
Figure 4:
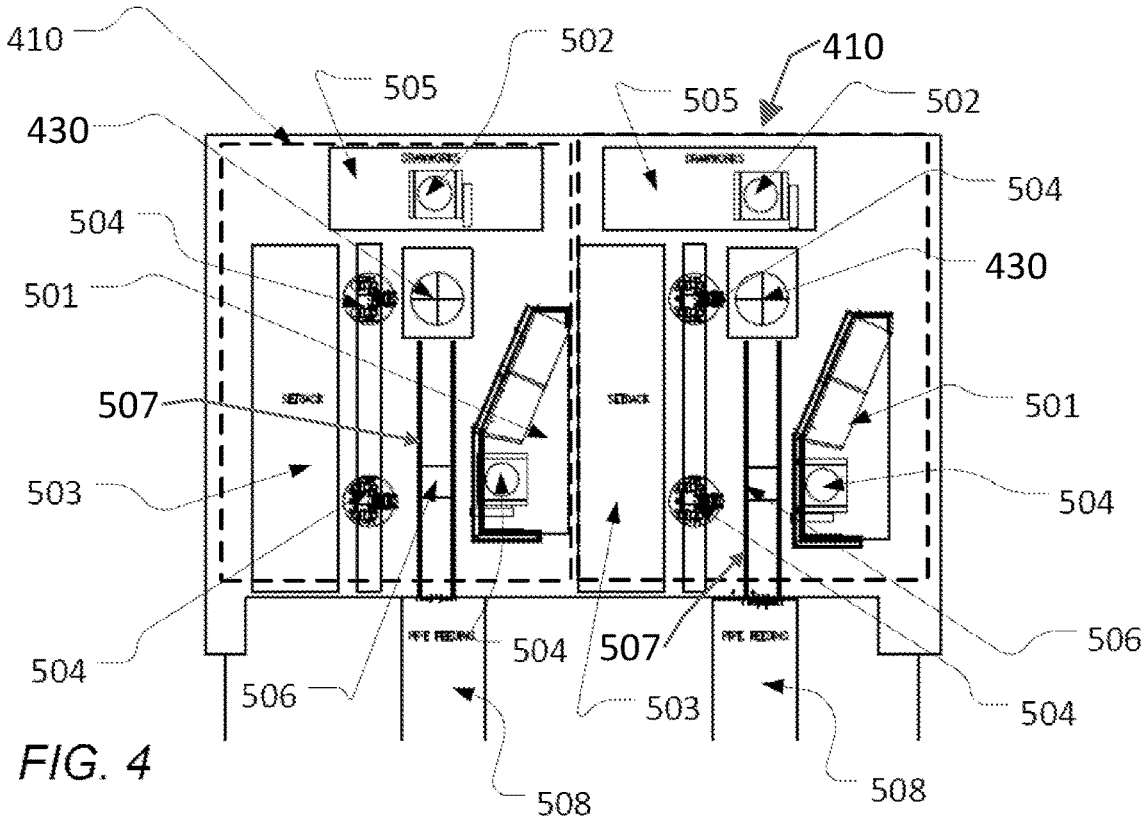
Figure 5:
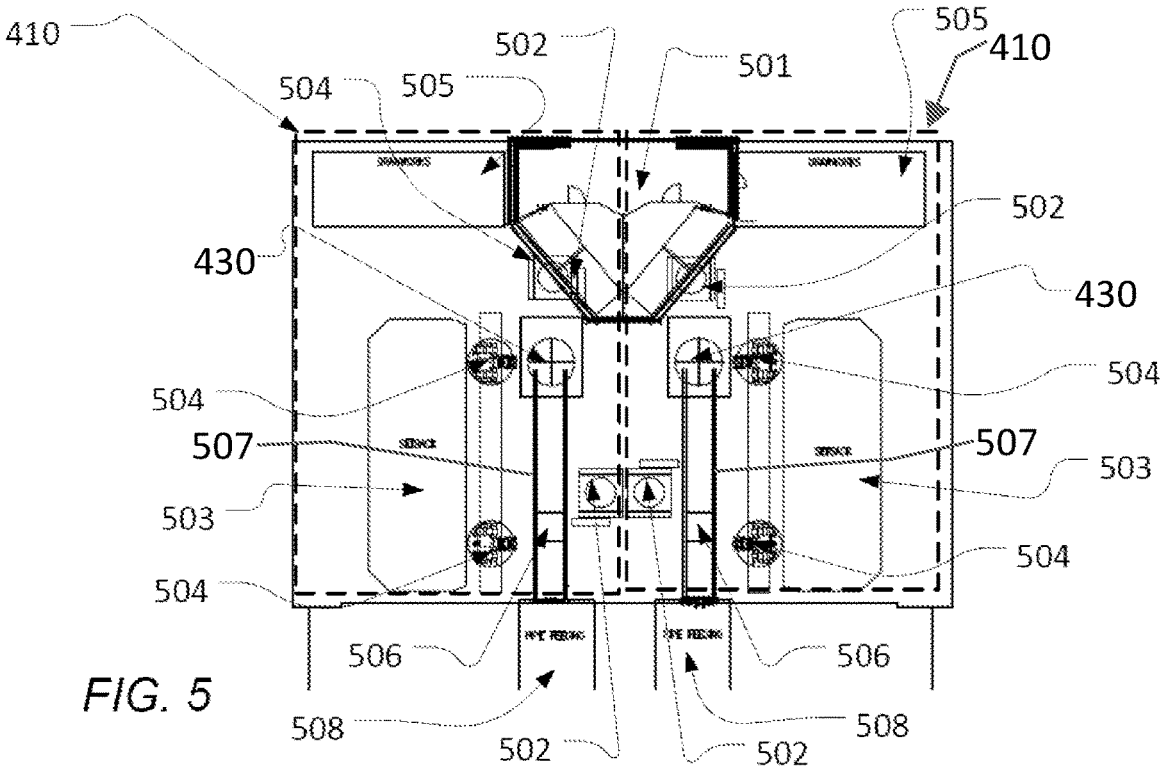

The driller's cabin(s) may be placed forward (closer to the main body of the drilling unit) of the well centers as in FIGS. 2-4 and 6 or aft of the well center as in FIG. 5. Placement aft of the well center has the advantage of good overview of tubulars entering the drilling stations as well as in relation to the well center but a drawback may be that the well center may need to be closer to the hull and thus may limit the reach of the cantilever. The reach of the cantilever is typically limited by the length of the cantilever and/or by the maximum deck load at the well center which typically decreases as the cantilever is extended.

In some embodiments, it may be preferable to raise some parts of the drilling station from the drill deck e.g. to provide a more compact layout and/or more deck space available for equipment. In the embodiments of FIG. 2-6 the driller's cabin 501 and drawworks 505 have been elevated. This may e.g. provide additional for an iron roughneck machine 502 (for making and breaking connections at the well center) below the drawworks and below the driller's cabin. In some embodiments, each drilling station 410 comprises a setback area 503 typically for storing stands vertically but horizontal storage is feasible. With separate setbacks the risk of interference between the operations at the two drilling stations is reduced.

In some embodiments, the setback area of the first and second drilling stations is a joint setback or adjacent and connected setback area. In this way stands and/or bottom-hole assemblies made up at one drilling station may be used by the other drilling station.

In some embodiments, the first and second drilling stations comprise multiple setback areas such as a separate setback area as well as a joint setback area.

In some embodiments, each of the first and second drilling stations comprises a pipe racker, such as the rackers 504. In some embodiments, each of the first and second drilling stations comprises two pipe rackers, e.g. as illustrated in FIGS. 2-6.

In some embodiments, the drilling station comprises one or more standbuilding stations. In the embodiments of FIGS. 2-6 the standbuilding station comprises a standbuilding center 506, such as a fox-hole, a pipe racker 504 (adjacent to the corresponding standbuilding center 506) and an iron roughneck 502 (adjacent to the corresponding standbuilding center 506). In some embodiments, the catwalk machine 508 can present tubulars to the pipe racker 504 which raises horizontal pipe to vertical and proceeds to make the connection between the pipe and a second pipe thus building a stand via the iron roughneck and the fox hole. The pipe racker may proceed to rack the finished stand made from two, three or more pipes back into the setback area 503 or present it at the well center. Offline (i.e. away from the well center) stand building e.g. via a fox hole is well known in the art. In some embodiments (such as in FIGS. 2-5), the offline stand building center is along the path for providing tubulars to the well center from outside of the drilling station. This is convenient in that a catwalk machine 508 will often provide most pipes for standbuilding but can conveniently progress to the well center 430 to present pipes here as well.

FIGS. 3-6 illustrate alternative embodiments of a drill floor layout of a drilling unit having two drilling stations on a single cantilever. The embodiments of FIGS. 3-6 comprise the components already described in connection with the embodiment of FIG. 2, but arranged in different layouts relative to each other. In particular, the embodiments of FIGS. 3-6 each comprise two drilling stations 410 arranged on a cantilever. The drilling stations comprise respective drawworks 505, well centers 430, setbacks 503, pipe rackers 504, iron roughnecks 502, standbuilding centers 506, rails 507, all as described above. The drilling units further comprise one or more driller's cabins 501, and catwalk machines 508, also all as described above.

In the embodiment of FIG. 2, the setback areas are positioned on the lateral side of the well centers that face away from the other well center. A common driller's cabin (accommodating two separate operator stations) is positioned centrally on the cantilever between the well centers. In the embodiment, the positions of the setback 503 and the driller's cabin are interchanged: The drilling unit of FIG. 3 comprises a shared setback area 503 positioned centrally between the well centers and two separate driller's cabins 501 that are positioned laterally outwards. It will be appreciated that, in this embodiment, the shared setback area 503 may still be large enough to provide separate, dedicated setback parts for the respective drilling stations.

In the embodiments of FIGS. 2 and 3, the layouts of the drilling stations are substantially mirrored relative to a center line dividing the drilling stations from each other. FIG. 4 shows a different embodiment where the drilling stations have substantially the same layout but translated transversely relative to each other. In particular, the embodiment of FIG. 4 comprises two separate driller's cabins 501 and two separate setback areas 503. While one setback area is positioned centrally on the cantilever, the other setback is positioned laterally outwards. Similarly, one of the driller's cabins is positioned central and the other laterally outwards.

The embodiment of FIG. 5 is similar to the embodiment of FIG. 2 with separate setback areas 503 positioned laterally outwards on respective sides of the drilling stations and with a shared driller's cabin. In this embodiment, the driller's cabin is positioned further rearwards on the cantilever (i.e. longitudinally displaced from the well centers further away from the main body of the drilling unit, but still substantially aligned with a longitudinal axis of the cantilever.) This placement of the driller's cabin allows the well centers 430 to be moved even more closely together, as illustrated in FIG. 5.

Figure 6:
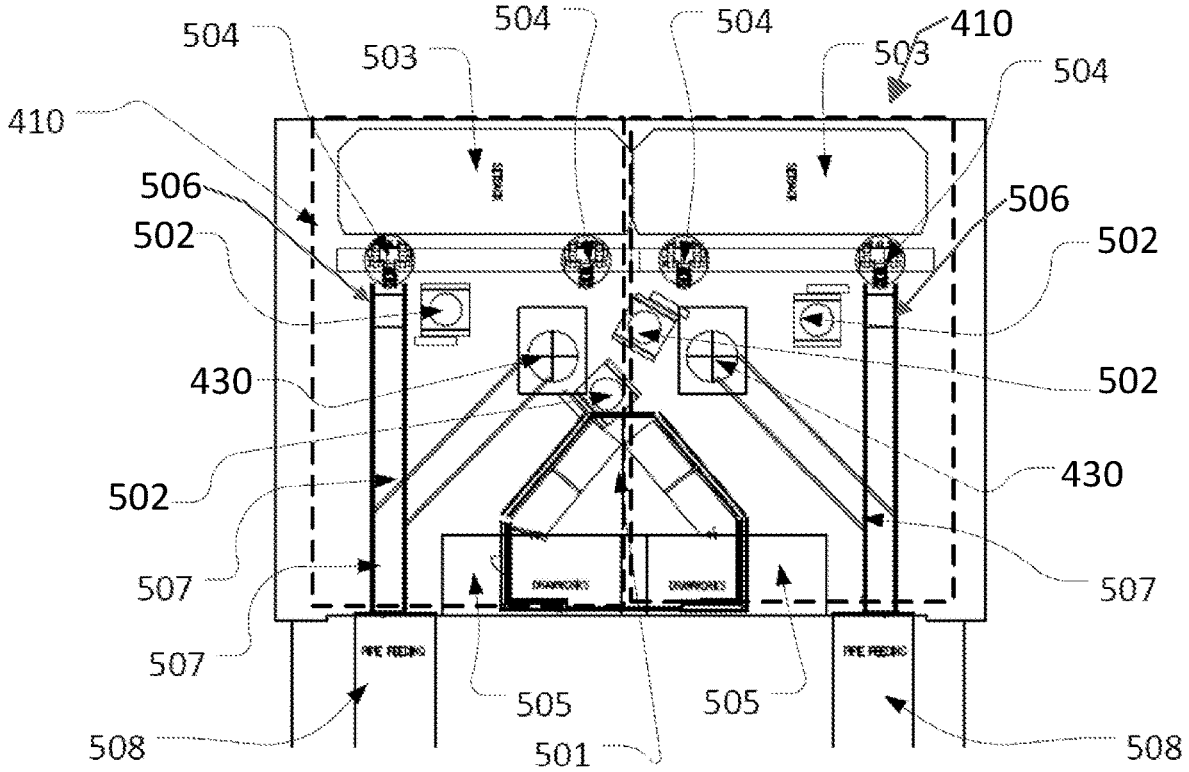

In the embodiment of FIG. 6, the setback areas are positioned at the most rearward end of the cantilever (on the side away from the main body of the drilling unit. The drawworks 505 and the elevated driller's cabin are positioned towards the front side of the drill floor, i.e. towards the main body of the drilling unit. This layout also allows a particularly small distance between the well centers.

As discussed above, it may be preferable to shield the operation at one drilling station from the operation at the other drilling station. Accordingly, in some embodiments, the offshore drilling unit comprises one or more partitions separating and/or shielding the plurality of drilling stations from each other. Such partitions may be placed where equipment of the two drilling stations are in proximity of each other and pose a risk of interference (such as dropped objects, well liquids or other hazardous items may transit between drilling stations). A partition may be movable or fixed and placed inside or on the cantilever. In one embodiment, a partition is placed to shield the drill floors of the drilling stations from each other. In the embodiments of FIGS. 2-6, the extent of the respective drilling stations 410 is indicated by respective dashed rectangles where one side of each rectangle faces an adjacent side of the corresponding other, neighbouring rectangle. A partition is preferably placed at least part of the way between the adjacent rectangles, along the sides of the rectangle that face the other rectangle.

Typically the distance between the well centers of the first and second (or even third or fourth) drilling stations is fixed. However, in some embodiments one or more of the well centers may be displaceable. Displaceable well centers are known from the PCT application WO14140369A2. In some embodiments one or more of the well centers (such as both or all) are displaceable over 50 cm, such as over 1 meter, such as over 2 meters, such as over 3 meters, such as over 4 meters, such as over 5 meters, such as over 6 meters, such as over 7 meters, such as over 8 meters, such as over 9 meters, such as over 10 meters, such as over 11 meters, such as over 12 meters. In some embodiments the well center may be displaceable to allow adjustment to match the location of the drilling centers on a well head platform. In some embodiments the drilling unit is arranged so that the first well center may be displaced to the second drilling station so that drilling can be performed through the first well center by the second drilling station. In this way the unit may provide redundancy and/or the ability to perform specialized operations at one of the stations and then skidding the well center of the other to have such operation performed.

As noted above, the offshore drilling unit of the invention is in particular advantageous for well-operations on surface wells supported by a platform with a configurable support structure as described in co-pending patent applications PA201500668, GB1607101.1, GB1607180.5, GB1607182.1, GB1522856.2 and GB1522857.0.

With reference to FIG. 7 and continued reference to FIG. 1, the following is a summary of various aspects of the configurable support structure (and its collaboration with the offshore drilling unit of the invention.

Traditionally, conductors may e.g. be arranged in a matrix type layout at their upper end. Once a well is completed it will typically have installed a production tree (also referred to as Christmas or x-mas tree) or similar on the well head making it ready for e.g. hydrocarbon extraction or production, injection, or other.

By surface-well is to be understood that the well-head of the well is located above the water level 110. Surface-wells are opposed to sub-sea wells, subsea trees, wet trees, etc.

In some embodiments, the offshore well-head platform 100 may be part of, or used in connection with, such an offshore facility, e.g. with facilities to extract and process hydrocarbons or other liquids and/or gasses, inject liquid(s) or gas(es) in one or more wells, and e.g. to temporarily store products somewhere until it can be brought to shore for refining, etc.

The offshore well-head platform 100 may be supported by resting on the seabed directly or indirectly, by being connected or attached to another structure, e.g. a drilling unit, jack-up drilling unit, etc., that is supported by resting on the seabed. The offshore well-head platform 100 may also be supported by or integrated into other types of units. In some embodiments a drilling unit as described herein may comprise a well head platform as described herein or at least parts thereof, e.g. a configurable support structure as described herein. For example, the support and optional manipulation of the conductors may be done utilizing the drive pipe support deck (also referred to as the Texas Deck) or similar.

The surface-wells 300 are connected to one or more offshore reservoirs (not shown) located below a seabed 120.

The offshore well-head platform 100 comprises a configurable support structure 200 for supporting upper parts of plurality of conductors 210 through which one or more well-processing tasks can be performed. Each conductor 210 forms part of a surface-well 300.

Even for embodiments, where the conductors 210 are considered relatively rigid, e.g. such as steel pipe or the like, they are sufficiently flexible to allow for some movement or deflection of its upper part or end—even when in place for extraction or production or injection—especially given their typical length (that typically will depend on the total depth of the well, i.e. the length from the well-head at the well head platform 100 to its location in the seabed near the relevant reservoir). Generally, the longer the conductors are above the seabed, the lesser angular deviation between its first positions at its shared second position is generally needed.

The time saving may be applicable to processing multiple wells both in a more traditional manner (completing one well at a time) and as batch-drilling (completing the same task(s) and/or sub-task(s) for all or at least some or several wells at a time).

Furthermore, as specialized equipment like skids, rails, cantilever are not needed or needed less they may be omitted or be of simpler design or used for other purposes.

Additionally, when the wells are completed and used for extraction or production or injection or other operations they may simply be 'parked' at an individual first position.

Once maintenance, work-over, etc. or other intervention is needed, the conductor 210 and its associated well may simply be moved to the shared second position again to carry out the maintenance or work-over process(es).

The angular deviation typically needed will depend on the specific design of the well head platform 100 or the configurable support structure 200 (e.g. the maximum distance that a conductor 210 should be designed to maximally move between a first and a shared second position, e.g. taking into account certain tolerances) and the length of the conductors 210, the material of the conductors 210 (and e.g. the number, dimensions, etc. of the smaller conduits being located inside the conductor 210), and so on.

Here and in the following, reference to a distance between respective positions (e.g. between a first and a shared second position) is intended to refer to the distance between the upper ends of conductors positioned at said positions. Purely as examples of a design of a well head platform 100 or the configurable support structure 200 e.g. comprising one centrally located, shared second position and six adjacent first positions (see e.g. FIG. 7) with a maximum distance (e.g. center-to-center distance) between the second and each individual first position being—purely as an example—about 1.3 meters, the smallest angular deviation needed may e.g. be about 0.8° for a water depth of about 70 meters (or corresponding length of the conductor 210 often being the water depth plus the length from the water level to the location of the well head platform/configurable support structure and plus the length of the conductor in the seabed), e.g. be about 1.0° for a water depth of about 60 meters, e.g. be about 1.1° for a water depth of about 50 meters (with the only varying parameter being the water depth).

In principle, the configurable support structure 200 could comprise one or more (further) conductors without a first and/or a shared second position.

At least one suitable mechanism is provided for moving or deflecting a conductor 210 between its first position and its shared second position. The at least one mechanism for moving the conductors may e.g. be located on the offshore well-head platform 100 or could be located on an offshore drilling unit. The mechanism may be any suitable mechanism capable of moving or deflecting (the upper part) of a conductor 210 e.g. by pulling, pushing, etc.

The well head platform 100 or the configurable support structure 200 may e.g. comprise two (or more) shared second positions for use with two (or more) well centers or drilling stations. They may belong to a single same group or cluster or alternatively to different groups or clusters.

In some embodiments, the conductors 210 are used at water depths e.g. being selected from about 30 meters to about 300 meters or from about 30 meters to about 150 meters. Various aspects and embodiments of a method of processing or drilling one or more offshore surface-wells using a configurable support structure 200 and embodiments thereof will now be described with reference to FIG. 7.

FIG. 7 schematically illustrates a top view of an exemplary embodiment of a part of a configurable support structure.

Shown from above or below is a configurable support structure (or at least a part thereof) such as the ones shown and explained in connection with FIG. 1 and throughout the present description.

The configurable support structure 200 comprises a number, here as an example six, of first positions 150 and a number, here as an example one, of shared second positions 160.

In the example of FIG. 7, the configurable support structure comprises a number of slots that extend radially from a central hole in a star-like arrangement. The central hole defines the shared second position while each slot defines a first position. More generally, in some embodiments, the first positions and the shared second positions are provided according to an arrangement wherein the shared second position(s) is/are provided substantially centrally and the first positions are arranged around the shared second position(s), e.g. in a substantially circular or oval pattern. It will be appreciated, however, that other geometries may be provided.

In each first position or slot 150 is shown one conductor 210. The conductors 210 may each comprise a smaller diameter conduit 215 and an even smaller diameter conduit 220, e.g. the production liner, as generally known. There may be an air-gap or space present at each first position or slot 150 for giving room between the conductors 210 and the configurable support structure 200. Also shown and indicated by 'A' is a center-to-center distance between two neighboring conductors 210 each in a first position.

Further shown and indicated by 'B' is a center-to-center distance between a center of the shared second position 160 and a center of each of the first positions 150. In some embodiments (and as shown), B will be substantially the same to all first positions or at least have a minimum distance for all associated first positions. However, it may also be different for at least some embodiments.

In some embodiments, A is selected from about 0.25 meters to about 10 meters. In some embodiments, A is selected from about 0.8 meters to about 5 meters. In some embodiments, A is selected from about 1 meter to about 2.5 meters. In some embodiments, A is selected from about 0.8 meters to about 2 meters. In some embodiments, A is selected from about 1.2 meters to about 1.9 meters.

In some embodiments, B is selected from about 0.25 meters to about 25 meters. In some embodiments, B is selected from about 0.5 meters to about 15 meters. In some embodiments, B is selected from about 1.5 meters to about 10 meters. In some embodiments, B is selected from about 1 meter to about 4 meters. In some embodiments, B is a value being larger than about 0.1 meters. In some embodiments, B is a value being larger than about 0.25 meters. In some embodiments, B is a value being larger than about 0.5 meters. In some embodiments, B is a value being larger than about 0.75 meters. In some embodiments, B is a value being larger than about 1 meter. In some embodiments, B is a value being larger than about 1.25 meters. In some embodiments, B is a value being larger than about 1.5 meters. In some embodiments, B is a value being larger than about 2 meters. In some embodiments, B is a value being larger than about 2.5 meters. In some embodiments, B is a value being larger than about 3 meters. In some embodiments, B is a value being larger than about 3.5 meters. In some embodiments, B is a value being larger than about 4 meters. In some embodiments, B is a value being larger than about 5 meters. In some embodiments, B is a value being larger than about 6 meters.

Finally, a working and/or drilling center zone 250 is indicated by a central darker dashed circle. It is noted, that the working and/or drilling center zone 250 does not form part of the configurable support structure 200 but rather is projected thereon to better illustrate its position in relation to the shared second position when used.

The offshore well-head platform comprising the configurable support structure 200 may comprise an opening at its upper structure (e.g. at the weather deck of the offshore well head platform) above the one or more shared second positions 160 that are to more or less coincide or at least overlap with the working and/or drilling center zone 250 defined by a drilling station of the drilling unit during well construction of a well/wells at a shared second position/positions. Also see FIGS. 5, 6a-6b, and 7 of GB 1522856.2 for examples of a configurable support structure together with an appropriate working and/or drilling center zone.

The configurable support structure 200 may e.g. be or comprise parts that are part of a wellhead deck (often also referred to as wellhead platform deck, cellar deck, well-bay area, well slot area, etc.) of an offshore wellhead platform. As a note, production trees of completed wells may be located at a deck (sometimes referred to as the Christmas tree deck) located between the weather deck and the well head deck.

As indicated by double arrows, the respective conductors 210 are movable between the first and shared second positions 150, 160 as explained in connection with FIG. 1 and throughout the present description.

The configurable support structure 200 may be used to carry out aspects of a method of processing or drilling one or more offshore surface-wells using an offshore drilling unit according to the invention. In some embodiments, the method comprises constructing and/or processing multiple offshore surface-wells from a single work or drill center position by moving one or more selected conductors to and from the single work or drill center position.

In some embodiments, the method comprises using at least one offshore well head platform as described elsewhere wherein the single work or drill center position is a shared second position.

In some embodiments, the method comprises progressing a plurality of surface-wells towards completion by moving one of the conductors 210 to a first position 150 from a shared second position 160 subsequent to carrying out one or more well constructing and/or processing tasks (e.g. including sub-tasks) to complete the surface-well of said conductor 210 at the shared second position 160. After the well has been completed (or at least progressed towards completion as desired), said conductor 210 is moved to a first position (e.g. to the position it has previously been positioned at, or to another one of the first positions). Then another one of the conductors 210 may be moved from its current first position to the shared second position for carrying out one or more well constructing and/or processing tasks on the well associated with said another conductor at the shared second position. This process may be repeated until all conductors as desired have been processed. In some embodiments, the conductor may be installed at the shared second position, in some embodiments, at its first, in some embodiment between these two positions and in some embodiments at a third position.

It should be noted that the method and embodiments thereof may be carried out, e.g. overlapping in time, at two (or more) shared second positions. The specific steps, tasks, etc. and their timing carried out at different shared second positions may and often will be different—although they may be the same.

In some alternative embodiments, the method comprises progressing a plurality of surface-wells towards completion by moving a selected conductor 210 from a first position 150, where it is located, to a shared second position 160 and carrying out at least one well constructing and/or processing task and/or sub-task. After the task(s) and/or sub-task(s) has/have been completed, the selected conductor is moved to a first position (original or different). Then a next conductor 210 is moved from its first position to the shared second position and the task(s) and/or sub-task(s) are carried out on or for the next conductor 210 after which it is moved to a first position (original or different). This is repeated until the relevant task(s) and/or sub-task(s) have been carried out on the desired conductors 210. Once that is the case, the next task(s) and/or sub-task(s) is/are carried out on all the desired conductors 210. The next task(s) and/or sub-task(s) need not—but may do so—start with the same conductor as was started with for the previous task and/or sub-task. This is repeated until all desired tasks and/or sub-tasks have been carried out for all desired conductors 210. In some embodiments, the conductor may be installed at the shared second position, in some embodiments at its first, in some embodiment between these two positions and in some embodiments at a third position.

Again, the process and variations thereof may be carried out, e.g. overlapping in time, at two (or more) shared second positions (then by two or more well-processing stations). The specific steps, tasks, etc. and their timing carried out at different shared second positions may and often will be different—although they may be the same.

In this way, efficiency is increased for batch drilling or batch processing a plurality of wells carrying out a group of one or more tasks and/or sub-tasks at a time on all the relevant conductors. The conductors need not necessarily be completed or progressed to the same extent, although they often will be.

After completion (by either method and embodiments thereof), the conductors may be secured at a number of first positions e.g. for production, injection or other operations.

The configurable support structure 200 may comprise one or more locking or securing mechanisms or elements (not shown; forth only referred to as securing elements).

In some embodiments, at least one securing element provides securing of one or more conductors at first positions 150 that, e.g. permanently, may lock at least one conductor in place at respective first positions, e.g. when the conductor is ready for extraction, production, injection, or similar. As examples of such securing elements are e.g. latches, clamps, wedges, or other securing elements.

In some embodiments (e.g. in combination with one or more of the embodiments described above), at least one securing element is provided at each shared second position 160 for temporarily and securely holding a conductor in place at a respective shared second position during well-processing, drilling, etc. Such securing elements may e.g. allow some degree of movement. Examples of such securing elements are e.g. mechanical or hydraulic push or pull, a rack and pinion drive, winch-wire, or any other suitable mechanisms for retaining, moving, shifting, etc. In some embodiments, the shared second position securing element may be combined with at least one mechanism for moving or deflecting a selected conductor between its first position and its shared second position.

In some embodiments (e.g. in combination with one or more of the ones described above), the offshore well head platform or the configurable support structure 200 comprises a number of collision prevention or separation elements 170 e.g. one for each first position 150 where the collision prevention or separation element forms a barrier or similar between the shared second position(s) 160 and the first positions 150 e.g. as indicated by the dashed line 170. Preferably, the collision prevention or separation elements will shield each first position 150 from the shared second position(s) 160, e.g. one collision prevention or separation element for each first position 150 or one collision prevention or separation element covering more or all first positions 150. As examples of such collision prevention elements are e.g. structural elements, beams, cushion or dampening elements, etc. One or more collision prevention or separation elements may e.g. be combined with one or more shared second position securing elements and/or the one securing element(s) providing securing of one or more conductors at first positions.

Such configurable support structures and methods as described above function particularly well together with embodiments of an offshore drilling unit comprising at least two drilling stations, wherein the drilling stations are capable of operating independently of each other although they need not to be or at least not to be all the time. In some embodiments, the drilling stations are each capable of constructing a respective well simultaneously. When operational, the distance between the two drilling stations may be fixed. Each of the at least two drilling stations may comprise their own mud supply, well control system, and mud return systems.

A shared second position (or a zone or area around it) may be used—e.g. after one or more wells have been completed at the shared second position—to complete one or more additional wells, e.g. those additional wells will have first positions located overlapping fully or partly with the shared second position(s) in question or a zone or area around the shared second position(s).

Note, that the shown position of the shared second position(s) is shown idealized in FIG. 7. Due to tolerances the one or more shared second positions will have a position within the working or drilling center zone 250.

In some embodiments, a shared second position and associated first positions is available for two or more drilling stations such as one or more for each drilling station. The position of the shared second positions is designed to match the well centers of the drilling stations of the offshore drilling unit. In some embodiments, two or more sets of shared second positions are provided so that subsequent to completing one set the cantilever can be skidded to the next set.

Figure 8:
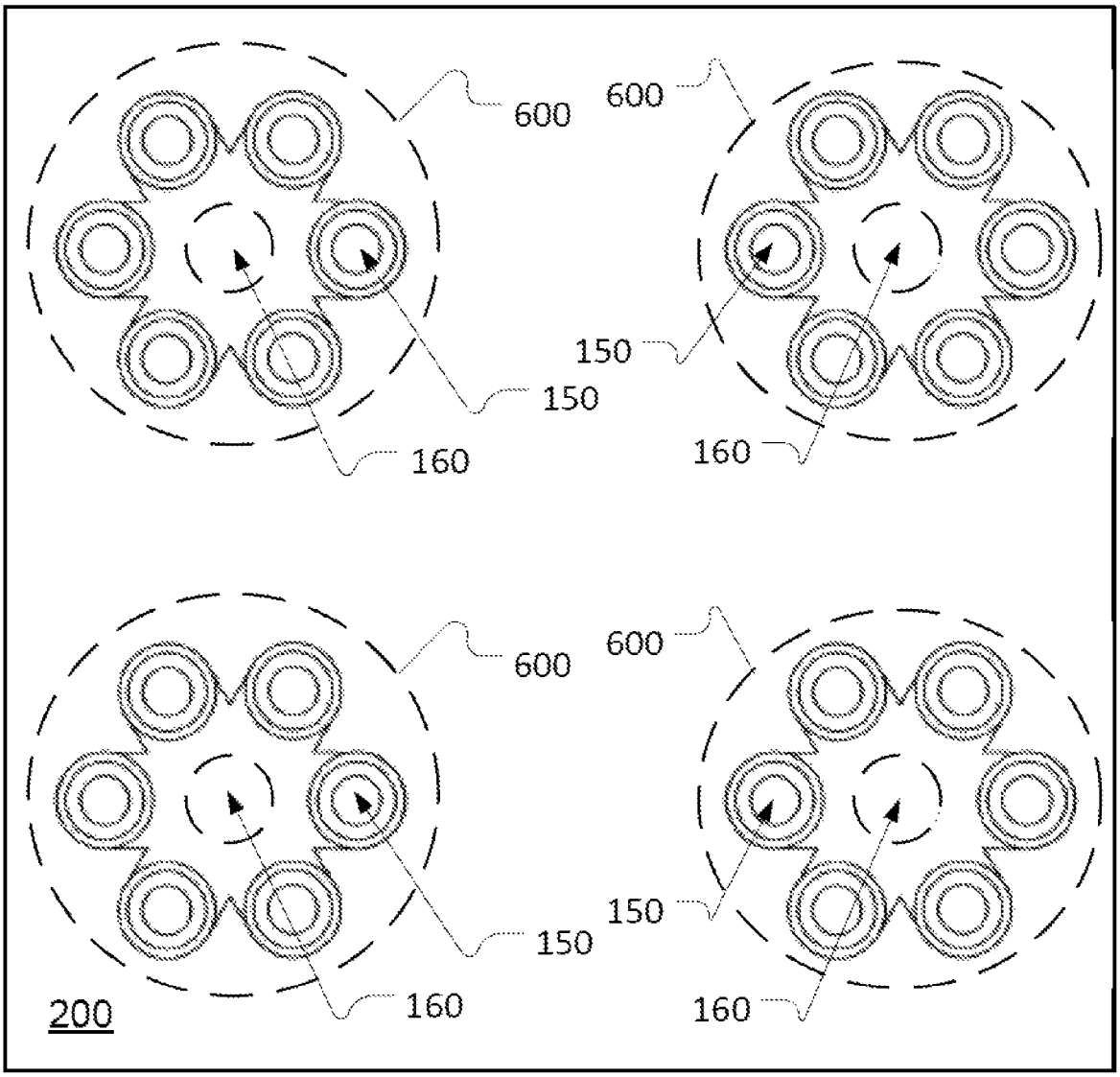

For example, FIG. 8 shows an example of a configurable support structure that comprises multiple (in this example four) shared second positions 160, each shared second position having a plurality of first positions 150 associated with it so as to form a cluster 600. Such an embodiment may be particularly useful in combination with a drilling unit having two drilling stations as described herein, as each drilling station may operate on a respective one of the clusters. When the processing of two clusters is finished (or at least has proceeded to a desired stage), the cantilever of the drilling unit may be repositioned such that the drilling stations can work on two further clusters.

The various aspects described herein have mainly been disclosed in the context of drilling units, but in some embodiments the various aspects may be used in relation with units specialized to perform other well-processing tasks that a drilling unit is either not suited for or that are more economically performed by a specialized rig. Such well-processing tasks may be one or more of well-completion, well-intervention, work-over and plug and abandonment. For such embodiments the drilling station may be replaced by a well-processing station with the equipment needed for the task and the well-center is replaced by a well-processing center. Hence, a skilled person will recognize that the invention may be applicable to well-processing systems in general including well-processing systems which are not drilling units, such as work-over rigs or rigs specialized for completion of wells.

While the present invention is advantageous for surface wells it may in some embodiment find utility for building subsea wells.

The invention claimed is:

1. An offshore drilling unit adapted for performing well-processing tasks on an off-shore hydrocarbon reservoir located below a seabed;

wherein the drilling unit comprising a bottom-supported hull and a cantilever movable relatively to the bottom-supported hull, the cantilever supporting a first drilling station defining a first well center, and a second drilling station defining a second well center;

wherein the drilling unit is configured to displace the cantilever to align the first drilling station and the second drilling station with a wellhead below the cantilever;

wherein at least the first drilling station is arranged displaceable in a horizontal plane relatively to the second drilling station; and wherein the drilling unit is configured to perform drilling and/or well control of a first well by the first drilling station while performing drilling and/or well control of a second well by the second drilling station, the first and the second drilling station comprises respective well control systems for preventing unintentional flow of well bore fluids between an open formation exposed to a well bore and the well bore.

2. The offshore drilling unit according to claim 1, wherein cantilever is provided with skids for being movable relatively to the bottom-supported hull.

3. The offshore drilling unit according to claim 1, wherein the first drilling station defining the first well center is provided with skids for being movable relatively to the cantilever.

4. The offshore drilling unit according to claim 3, wherein the second drilling station defining the second well center is provided with skids for being movable relatively to the cantilever.

5. The offshore drilling unit according to claim 1, wherein the first drilling station and the second drilling station each are adapted for performing one or more well-processing tasks on a plurality of surface-wells of one or more off-shore hydrocarbon reservoirs located below a seabed.

6. The offshore drilling unit according to claim 1, wherein the drilling operations the first and the second well are performed simultaneously.

7. The offshore drilling unit according to claim 1, wherein the wellhead below the cantilever is provided by a bottom-supported wellhead platform comprising a support structure supporting a platform disposed between the cantilever and the sea surface.

8. The offshore drilling unit according to claim 1, wherein the cantilever is for positioning the first well center and the second well center outside of the horizontal contour of the bottom-supported hull.

9. The offshore drilling unit according to claim 1, wherein the first drilling station and second drilling station are arranged to operate substantially independently from each other.

10. The offshore drilling unit according to claim 1, wherein the first drilling station comprises a first well control system, and wherein the second drilling station comprises a second well control system.

11. The offshore drilling unit according to claim 10, wherein the first and/or the second well control system is arranged to provide well control via a blowout preventer (BOP).

12. The offshore drilling unit according to claim 10, wherein the first and second drilling stations each comprises a BOP.

13. The offshore drilling unit according to claim 1, wherein the offshore drilling unit comprises a pipe storage for tubulars for running through the well center and towards the seabed and into the well, and wherein the offshore drilling unit is arranged to provide first and second paths for feeding tubulars to the first and second well centers, wherein each of the first and second paths comprise separate sections.

14. The offshore drilling unit according to claim 13, wherein the first and second paths comprises separate sections each running from a pipe storage outside of the drilling stations and to the respective first and second drilling stations.

15. The offshore drilling unit according to claim 14, comprising one or more machines for tubular handling;

wherein the one or more machines for tubular handling form part of said separate sections of the first and second path; and wherein the one or more machines for tubular handling are selected from the group of a catwalk machine, a V-door machine, a tugger and an overhead crane.

16. The offshore drilling unit according to claim 13, wherein the cantilever further comprises two catwalks, each aligned with one of the separate sections of the first and second paths and the catwalks are part of a pipe deck of the cantilever.

17. The offshore drilling unit according to claim 1, wherein the offshore drilling unit comprises respective driller's cabins or operating stations for each of the two of drilling stations.

18. The offshore drilling unit according to claim 1 and being a jack-up drilling unit.

19. The offshore drilling unit according to claim 1, wherein the respective well-control systems utilize separate components that are dedicated to respective ones of the drilling stations.

20. The offshore drilling unit according to claim 19, wherein the separate components of the respective well-control systems comprise separate BOPs, separate diverters, separate choke-and-kill manifolds.

21. The offshore drilling unit according to claim 20, wherein the BOPs are arranged on a wellhead platform above sea surface.

22. A method for performing well-processing tasks on an off-shore hydrocarbon reservoir located below a seabed by applying a drilling unit comprising a bottom-supported hull and a cantilever movable relatively to the bottom-supported hull, the cantilever supporting a first drilling station defining a first well center, and a second drilling station defining a second well center; the method comprising:

displacing the cantilever to align the first drilling station and the second drilling station with a wellhead below the cantilever; and displacing the first drilling in a horizontal plane relatively to the second drilling station, wherein the drilling unit is configured to perform drilling and/or well control of a first well by the first drilling station while performing drilling and/or well control of a second well by the second drilling station, the first and the second drilling station comprises respective well control systems for preventing unintentional flow of well bore fluids between an open formation exposed to a well bore and the well bore.

23. An offshore drilling system comprising:

an offshore drilling unit adapted for performing at least one well-processing task on a surface-well of an off-shore hydrocarbon reservoir located below a seabed; and a bottom-supported wellhead platform comprising a support structure supporting the wellhead;

wherein the drilling unit comprising a bottom-supported hull and a cantilever movable relatively to the bottom-supported hull, the cantilever supporting:

a first drilling station defining a first well center, and a second drilling station defining a second well center;

wherein the drilling unit is configured to displace the cantilever to align the first drilling station and the second drilling station with a wellhead on the bottom-supported wellhead platform below the cantilever;

wherein at least the first drilling station is arranged displaceable in a horizontal plane relatively to the second drilling station; and wherein the drilling unit is configured to perform drilling and/or well control of a first well by the first drilling station while performing drilling and/or well control of a second well by the second drilling station, the first and the second drilling station comprises respective well control systems for preventing unintentional flow of well bore fluids between an open formation exposed to a well bore and the well bore.

* * * * *